US010791844B2

(12) United States Patent
Le Gette et al.

(10) Patent No.: US 10,791,844 B2
(45) **Date of Patent: *Oct. 6, 2020**

(54) COLLAPSIBLE FLOTATION DEVICE

(71) Applicant: SPIN MASTER, INC., Williamsville, NY (US)

(72) Inventors: Brian Edward Le Gette, Baltimore, MD (US); David Reeb, Columbia, MD (US); Alan Tipp, Baltimore, MD (US); Justin Saul Werner, Severna Park, MD (US); Ronald L. Wilson, II, Solana Beach, CA (US); Inna Alesina, Owings Mills, MD (US)

(73) Assignee: SPIN MASTER, INC., Williamsville ( * ) Notice: Subject to any disclaimer, the term of this patent is extended or adjusted under 35 U.S.C. 154(b) by 0 days.

This patent is subject to a terminal disclaimer.

(21) Appl. No.: 15/463,870

(22) Filed: Mar. 20, 2017

(65) Prior Publication Data

US 2017/0188713 A1 Jul. 6, 2017

Related U.S. Application Data

(63) Continuation of application No. 14/186,886, filed on Feb. 21, 2014, now Pat. No. 9,630,687, which is a (Continued)

(51) Int. Cl.
*B63C 9/08* (2006.01)
*B63C 9/28* (2006.01)
(Continued)

(52) U.S. Cl.
CPC ..... *A47C 15/006* (2013.01); *B63B 7/08* (2013.01); *B63B 34/50* (2020.02); *B63B 2029/043* (2013.01)

(58) Field of Classification Search
CPC .... B63B 7/00; B63B 7/06; B63B 7/08; B63B 35/74; B63B 35/76; B63B 2029/43; A47C 15/006
(Continued)

(56) References Cited

U.S. PATENT DOCUMENTS 856,279 A 6/1907 Moore
1,190,743 A 7/1916 Fageol
(Continued)

FOREIGN PATENT DOCUMENTS

EP 0 974 293 A2 1/2000
FR 2697421 4/1996
(Continued)

OTHER PUBLICATIONS

Aqua-Leisure 1993 Catalog, pp. 7, 12-13.
(Continued)

*Primary Examiner* — Daniel V Venne
(74) *Attorney, Agent, or Firm* — Millman IP Inc.

(57) ABSTRACT

A collapsible flotation device is provided that uses a coilable spring coupled to a panel to collapse the device when the spring is coiled, and to expand the device when the spring is uncoiled configuration. The spring can be contained within a sleeve along the outer portion of the panel. A support member that traverses the panel is provided. An inflatable bladder disposed about a part of the outer portion of the panel and coupled to the support member buoyantly supports a body weight of a user. The combination of the inflatable bladder and the support member provide support for a user in a seated position on the panel. Many configurations are disclosed, including a multi-user collapsible flotation device, multiple connected single-user flotation devices, and so forth. A back support member and a headrest, both of which can be inflatable, provide additional
(Continued)

support for a user to maintain a seated position on the panel. A foot support member is provided for the comfort of the user.

7 Claims, 19 Drawing Sheets

Related U.S. Application Data continuation of application No. 13/305,365, filed on Nov. 28, 2011, now Pat. No. 8,657,640, which is a continuation of application No. 12/788,473, filed on May 27, 2010, now Pat. No. 8,066,540, which is a continuation of application No. 11/139,493, filed on May 31, 2005, now Pat. No. 7,727,038, which is a continuation of application No. 10/370,082, filed on Feb. 21, 2003, now Pat. No. 6,971,936.

(51) Int. Cl.

| | |
|---|---|
| ***A47C 15/00*** | (2006.01) |
| ***B63B 7/08*** | (2020.01) |
| ***B63B 34/50*** | (2020.01) |
| *B63B 29/04* | (2006.01) |

(58) Field of Classification Search
USPC ..... 441/129–132; 297/188.14; 472/129
See application file for complete search history.

(56) References Cited

U.S. PATENT DOCUMENTS

| | | | |
|---|---|---|---|
| 1,479,903 | A | 1/1924 | Erland |
| 1,960,474 | A | 5/1934 | Browne |
| 2,119,023 | A | 5/1938 | Pickard |
| 2,207,025 | A | 9/1938 | Rison |
| 2,173,963 | A | 9/1939 | Eubank |
| 2,190,566 | A | 2/1940 | Julian |
| 2,344,010 | A | 3/1944 | Walsh |
| 2,357,789 | A | 9/1944 | Levy |
| 2,420,344 | A | 5/1947 | Alexander |
| 2,442,105 | A | 5/1948 | Vacheron |
| 2,637,861 | A | 5/1953 | Kethledge |
| 2,731,997 | A | 1/1956 | Muth et al. |
| 2,803,291 | A | 8/1957 | Meyer |
| 2,803,839 | A | 8/1957 | Mosley |
| 2,870,464 | A | 1/1959 | Lalick |
| D187,313 | S | 2/1960 | Denyer |
| 3,052,895 | A | 9/1962 | Lo Vico |
| 3,336,610 | A | 8/1967 | Geddings |
| 3,602,930 | A | 9/1971 | Channon |
| 3,653,084 | A | 4/1972 | Hartman |
| D225,183 | S | 11/1972 | Waters |
| 3,775,782 | A | 12/1973 | Rice et al. |
| 3,860,976 | A | 1/1975 | Suyama |
| 3,862,876 | A | 1/1975 | Graves |
| 3,871,042 | A | 3/1975 | Farmer |
| 3,960,161 | A | 6/1976 | Norman |
| 3,990,463 | A | 11/1976 | Norman |
| 4,097,944 | A | 7/1978 | Yulish |
| 4,200,942 | A | 5/1980 | Case |
| 4,231,125 | A | 11/1980 | Tittl |
| D261,464 | S | 10/1981 | Smith |
| 4,296,788 | A | 10/1981 | Slater |
| 4,478,587 | A | 10/1984 | Mackal |
| 4,512,049 | A | 4/1985 | Henry |
| 4,561,480 | A | 12/1985 | Underwood et al. |
| 4,576,375 | A | 3/1986 | Roberts |
| D289,075 | S | 3/1987 | Wolfe |
| D293,012 | S | 12/1987 | Storey et al. |
| 4,709,430 | A | 12/1987 | Nicoll |
| 4,766,918 | A | 8/1988 | Odekirk |
| 4,815,784 | A | 3/1989 | Zheng |
| 4,825,892 | A | 5/1989 | Norman |
| 4,858,634 | A | 8/1989 | McLeese |
| 4,905,332 | A | 3/1990 | Wang |
| 4,942,838 | A | 7/1990 | Boyer et al. |
| 4,944,707 | A | 7/1990 | Silverglate |
| 4,946,067 | A | 8/1990 | Kelsall |
| 4,951,333 | A | 8/1990 | Kaiser et al. |
| 4,973,278 | A | 11/1990 | Williams |
| 4,976,642 | A | 12/1990 | Wilkie |
| 4,986,781 | A | 1/1991 | Smith |
| 5,004,296 | A | 4/1991 | Ziegenfuss, Jr. |
| 5,006,087 | A | 4/1991 | Peterson |
| 5,024,262 | A | 6/1991 | Huang |
| 5,038,812 | A | 8/1991 | Norman |
| 5,045,011 | A | 9/1991 | Lovik |
| 5,046,978 | A | 9/1991 | Howerton |
| 5,056,172 | A | 10/1991 | Kaiser et al. |
| 5,059,463 | A | 10/1991 | Peters |
| 5,070,807 | A | 12/1991 | Lewis |
| D325,489 | S | 4/1992 | Pratt |
| 5,116,273 | A | 5/1992 | Chan |
| 5,123,869 | A | 6/1992 | Schipmann |
| D328,324 | S | 7/1992 | Wang |
| 5,163,192 | A | 11/1992 | Watson |
| 5,163,461 | A | 11/1992 | Ivanovich et al. |
| 5,167,554 | A | 12/1992 | Tager |
| 5,186,667 | A | 2/1993 | Wang |
| 5,206,964 | A | 5/1993 | Wilson, Sr. |
| 5,213,147 | A | 5/1993 | Zheng |
| 5,261,131 | A | 11/1993 | Kilby |
| 5,299,331 | A | 4/1994 | Badillo |
| D349,593 | S | 8/1994 | Hensley |
| D349,625 | S | 8/1994 | da Palma |
| 5,334,067 | A | 8/1994 | Henry et al. |
| D350,586 | S | 9/1994 | Francis |
| 5,345,627 | A | 9/1994 | Cammarata |
| 5,358,440 | A | 10/1994 | Zheng |
| 5,385,518 | A | 1/1995 | Turner |
| 5,396,917 | A | 3/1995 | Hazinski et al. |
| 5,430,980 | A | 7/1995 | Ferrier |
| 5,433,433 | A | 7/1995 | Armell |
| 5,435,025 | A | 7/1995 | Gerard et al. |
| 5,454,643 | A | 10/1995 | Sullivan |
| 5,467,794 | A | 11/1995 | Zheng |
| 5,476,404 | A | 12/1995 | Price |
| D366,161 | S | 1/1996 | Arcouette |
| D366,177 | S | 1/1996 | Dean |
| 5,507,674 | A | 4/1996 | Yeung |
| 5,520,561 | A | 5/1996 | Langenohl |
| D371,252 | S | 7/1996 | Chaput |
| 5,533,653 | A | 7/1996 | Kaufman |
| D373,483 | S | 9/1996 | Peterson |
| 5,560,385 | A | 10/1996 | Zheng |
| 5,571,036 | A | 11/1996 | Hannigan |
| 5,579,799 | A | 12/1996 | Zheng |
| 5,592,961 | A | 1/1997 | Chin |
| 5,618,110 | A | 4/1997 | Sullivan |
| 5,618,246 | A | 4/1997 | Zheng |
| RE35,571 | E | 7/1997 | McLeese |
| 5,644,807 | A | 7/1997 | Battistella |
| D384,721 | S | 10/1997 | Peterson |
| 5,688,052 | A | 11/1997 | Compton |
| 5,693,398 | A | 12/1997 | Granger |
| D389,362 | S | 1/1998 | Boulatian |
| 5,718,612 | A | 2/1998 | Elsholz |
| 5,729,846 | A | 3/1998 | Sullivan |
| 5,730,529 | A | 3/1998 | Fritz et al. |
| D398,694 | S | 9/1998 | Boddy |
| 5,810,695 | A | 9/1998 | Sass |
| 5,816,954 | A | 10/1998 | Zheng |
| D400,749 | S | 11/1998 | Bechtold, Jr. |
| D404,104 | S | 1/1999 | Scheurer et al. |
| D406,299 | S | 3/1999 | Huston |
| D406,870 | S | 3/1999 | Bauman |
| 5,885,123 | A | 3/1999 | Clifford |
| D416,063 | S | 11/1999 | Scheurer et al. |
| 5,976,023 | A | 11/1999 | Cho |
| 6,012,778 | A | 1/2000 | Peterson |
| 6,030,300 | A | 2/2000 | Zheng |
| D424,313 | S | 5/2000 | Linder |

(56) References Cited

U.S. PATENT DOCUMENTS

| | | | | |
|---|---|---|---|---|
| D425,357 | S | 5/2000 | Waring | |
| D426,415 | S | 6/2000 | Le Gette et al. | |
| D426,714 | S | 6/2000 | Linder | |
| 6,073,283 | A | 6/2000 | Zheng | |
| D428,090 | S | 7/2000 | Peterson | |
| D428,099 | S | 7/2000 | Peterson | |
| 6,086,150 | A | 7/2000 | Scheurer et al. | |
| 6,113,453 | A | 9/2000 | Stuffelbeam | |
| D435,240 | S | 12/2000 | Peterson | |
| 6,161,902 | A | 12/2000 | Lieberman | |
| 6,168,489 | B1 | 1/2001 | Huston | |
| 6,170,100 | B1 | 1/2001 | Le Gette et al. | |
| 6,173,671 | B1 | 1/2001 | Casull | |
| D437,283 | S | 2/2001 | Peterson | |
| 6,192,635 | B1 | 2/2001 | Zheng | |
| 6,223,673 | B1 | 5/2001 | Mears et al. | |
| 6,224,444 | B1 | 5/2001 | Klimenko | |
| 6,257,943 | B1 | 7/2001 | Peterson | |
| 6,276,979 | B1 | 8/2001 | Saltel et al. | |
| D447,661 | S | 9/2001 | Le Gette et al. | |
| D449,193 | S | 10/2001 | Le Gette et al. | |
| 6,312,054 | B1 | 11/2001 | Scheurer | |
| 6,343,391 | B1 | 2/2002 | Le Gette et al. | |
| D459,934 | S | 7/2002 | Le Gette et al. | |
| D463,700 | S | 10/2002 | Le Gette et al. | |
| D465,540 | S | 11/2002 | Peterson | |
| D466,176 | S | 11/2002 | Peterson | |
| 6,485,344 | B2 | 11/2002 | Arias | |
| 6,491,558 | B1 | 12/2002 | Myers | |
| D469,494 | S | 1/2003 | Arias | |
| D480,777 | S * | 10/2003 | Peterson | D21/803 |
| D481,435 | S | 10/2003 | Zheng | |
| 6,634,040 | B2 | 10/2003 | Le Gette et al. | |
| 6,645,026 | B2 | 11/2003 | Kuan | |
| D483,088 | S | 12/2003 | Zheng | |
| D485,593 | S | 1/2004 | Muci | |
| D492,380 | S | 6/2004 | Zheng | |
| 6,881,114 | B2 | 4/2005 | Zheng | |
| 6,908,353 | B2 | 6/2005 | Zheng | |
| 6,915,537 | B2 | 7/2005 | Le Gette et al. | |
| 6,971,936 | B2 | 12/2005 | Le Gette et al. | |
| 7,097,524 | B2 | 8/2006 | Arias | |
| 7,127,754 | B2 | 10/2006 | Le Gette et al. | |
| 7,134,930 | B2 | 11/2006 | Arias | |
| 7,137,856 | B2 | 11/2006 | Zheng | |
| 7,147,528 | B2 | 12/2006 | Arias | |
| 7,207,857 | B2 | 4/2007 | Zheng | |
| 7,314,399 | B2 | 1/2008 | Turner | |
| 7,335,080 | B2 | 2/2008 | Arias | |
| 7,370,379 | B2 | 5/2008 | Zheng | |
| 7,490,378 | B2 | 2/2009 | Le Gette et al. | |
| 7,500,893 | B2 | 3/2009 | Arias | |
| D596,438 | S | 7/2009 | Le Gette et al. | |
| D610,216 | S | 2/2010 | Le Gette et al. | |
| 7,665,164 | B2 | 2/2010 | Le Gette et al. | |
| 7,727,038 | B2 | 6/2010 | Le Gette et al. | |
| 7,811,145 | B2 | 10/2010 | Arias | |
| D632,914 | S | 2/2011 | Le Gette et al. | |
| D640,492 | S | 6/2011 | Le Gette et al. | |
| 8,079,888 | B2 | 12/2011 | Arias | |
| D654,749 | S | 2/2012 | Le Gette et al. | |
| 8,523,623 | B2 | 9/2013 | Arias | |
| 8,657,640 | B2 | 2/2014 | Le Gette et al. | |
| D702,058 | S | 4/2014 | Le Gette et al. | |
| D742,139 | S | 11/2015 | Le Gette | |
| 9,221,526 | B2 | 12/2015 | Arias | |
| 9,849,949 | B2 | 12/2017 | Arias | |
| 2002/0049017 | A1 | 4/2002 | Ross | |
| 2003/0134549 | A1 | 7/2003 | Lekhtman | |
| 2003/0134559 | A1 * | 7/2003 | Delzer | A61F 13/15658 442/394 |
| 2016/0114872 | A1 | 4/2016 | Arias | |

FOREIGN PATENT DOCUMENTS

| | | | |
|---|---|---|---|
| GB | 2108435 | B | 4/1985 |
| JP | 48024199 | U | 7/1971 |

OTHER PUBLICATIONS

Aqua-Leisure Adjustable Sunshade Wave Rider packaging 2001.
Aqua-Leisure Baby Boat packaging 1992.
Aqua-Leisure Squirtin' Tootin' Tugboat packaging 2001.
Bestway 2000 Catalog, pp. 8, 15, 28, and 73-74.
Bestway 2002 Catalog, 2 pages.
Bestway 2003 Catalog, pp. 36, 51-52, 54.
Intex 1994 Catalog, pp. 17, 30.
Intex 1999 Catalog, p. 41.
Intex 2001 Catalog, p. 34.
Swimclass Baby Boat packaging 2003.
Swimline 1999 Catalog, pp. A1, 19.
Swimline 2002 Catalog, p. 31.
Swimways 1995 Catalog, Swimways Corp., 1995, pp. 5 and 18-19.
Swimways 1996 Catalog, Swimways Corp., 1996, pp. 4 and 20-23.
Swimways 1997 Catalog, Swimways Corp., 1997, pp. 6 and 18-20.
Swimways 1998 Catalog, Swimways Corp., 1998, pp. 13 and 15-17.
Swimways 1999 Catalog, Swimways Corp., 1999, pp. 10 and 21-22.
Swimways 2000 Catalog, Swimways Corp., 2000, pp. 2-5 and 17.
Swimways Lounges Summer 2001 Catalog, Swimways Corp., 2001, pp. 2-8.
Don Hubbard, The Complete Book of Inflatable Boats (1980).
Hawley's Condensed Chemical Dictionary, Definition of "Resin, Synthetic" p. 1004 (1987).
Life Buoy as a Water Hammock, 16 Popular Mechanics, No. 3, 309, 313 (1911).
Examination Report for Australian Patent Application No. 2015203143, dated Sep. 23, 2016.
International Search Report and Written Opinion for PCT/US04/04517, dated Jul. 29, 2004; 10 pages.
Office Action for Chinese Patent Application No. 200410005842.2, dated May 11, 2007; 9 pages.
Office Action for Chinese Patent Application No. 200410005842.2, dated Nov. 2, 2007; 4 pages.
Office Action for European Application No. 04711822.9, dated Oct. 8, 2010; 6 pages.
Supplementary European Search Report for European Application No. 04711822.9, dated Apr. 28, 2010; 5 pages.
Aqua-Leisure's Opening Claim Construction Brief, filed Feb. 28, 2017 in *Swimways Corporation et al.* v. *Aqua-Leisure Industries, Inc.* 2:16-cv-00260, 34 pages.
Claim Construction Order, mailed Apr. 24, 2017 in*Swimways Corporation et al.* v. *Aqua-Leisure Industries, Inc.* 2:16-cv-00260, 33 pages.
Defendant Aqua-Leisure Industries, Inc.'s Amended Counterclaims, filed on Sep. 20, 2016 in *Swimways Corporation et al.* v. *Aqua-Leisure Industries, Inc.* 2:16-cv-00260, 19 pages.
Defendant Bestway (USA) Inc.'s Opening Expert Report of Samir Nayfeh, Ph.D. Relating to the Validity of U.S. Pat. No. 7,811,145; U.S. Pat. No. 8,079,888; and U.S. Pat. No. 8,066,540, filed on Nov. 3, 2016 in *Swimways Corporation et al.* v. *Bestway (USA) Inc.* 1:16-cv-608, 120 pages.
Defendant's Prior Art Statement, filed on Sep. 30, 2013 in *Swimways Corporation* v. *Aqua-Leisure Industries, Inc.* 3:12-cv-00205, 66 pages.
Markman Order, issued on Oct. 22, 2013, in *Swimways Corporation* v. *Aqua-Leisure Industries, Inc.* 3:12-cv-00205, 5 pages.
Plaintiffs' Opening Claim Construction Brief, filed Feb. 28, 2017 in *Swimways Corporation et al.* v. *Aqua-Leisure Industries, Inc.* 2:16-cv-00260, 32 pages.
Schedule C-1 of Defendant Bestway (USA) Inc.'s Opening Expert Report of Samir Nayfeh, Ph.D. Relating to the Validity of U.S. Pat. No. 7,811,145; U.S. Pat. No. 8,079,888; and U.S. Pat. No. 8,066,540, filed on Nov. 3, 2016 in *Swimways Corporation et al.* v. *Bestway (USA) Inc.* 1:16-cv-608, 13 pages.

(56) References Cited

OTHER PUBLICATIONS

Schedule C-2 of Defendant Bestway (USA) Inc.'s Opening Expert Report of Samir Nayfeh, Ph.D. Relating to the Validity of U.S. Pat. No. 7,811,145; U.S. Pat. No. 8,079,888; and U.S. Pat. No. 8,066,540, filed on Nov. 3, 2016 in *Swimways Corporation et al.* v. *Bestway* (*USA*) *Inc.* 1:16-cv-608, 7 pages.
Schedule C-3 of Defendant Bestway (USA) Inc.'s Opening Expert Report of Samir Nayfeh, Ph.D. Relating to the Validity of U.S. Pat. No. 7,811,145; U.S. Pat. No. 8,079,888; and U.S. Pat. No. 8,066,540, filed on Nov. 3, 2016 in *Swimways Corporation et al.* v. *Bestway* (*USA*) *Inc.* 1:16-cv-608, 15 pages.
Schedule C-4 of Defendant Bestway (USA) Inc.'s Opening Expert Report of Samir Nayfeh, Ph.D. Relating to the Validity of U.S. Pat. No. 7,811,145; U.S. Pat. No. 8,079,888; and U.S. Pat. No. 8,066,540, filed on Nov. 3, 2016 in *Swimways Corporation et al.* v. *Bestway* (*USA*) *Inc.* 1:16-cv-608, 24 pages.
Schedule C-5 of Defendant Bestway (USA) Inc.'s Opening Expert Report of Samir Nayfeh, Ph.D. Relating to the Validity of U.S. Pat. No. 7,811,145; U.S. Pat. No. 8,079,888; and U.S. Pat. No. 8,066,540, filed on Nov. 3, 2016 in *Swimways Corporation et al.* v. *Bestway* (*USA*) *Inc.* 1:16-cv-608, 26 pages.
Schedule C-6 of Defendant Bestway (USA) Inc.'s Opening Expert Report of Samir Nayfeh, Ph.D. Relating to the Validity of U.S. Pat. No. 7,811,145; U.S. Pat. No. 8,079,888; and U.S. Pat. No. 8,066,540, filed on Nov. 3, 2016 in *Swimways Corporation et al.* v. *Bestway* (*USA*) *Inc.* 1:16-cv-608, 8 pages.
Schedule C-7 of Defendant Bestway (USA) Inc.'s Opening Expert Report of Samir Nayfeh, Ph.D. Relating to the Validity of U.S. Pat. No. 7,811,145; U.S. Pat. No. 8,079,888; and U.S. Pat. No. 8,066,540, filed on Nov. 3, 2016 in *Swimways Corporation et al.* v. *Bestway* (*USA*) *Inc.* 1:16-cv-608, 13 pages.

* cited by examiner

COLLAPSIBLE FLOTATION DEVICE

CROSS-REFERENCE TO RELATED APPLICATIONS

This application is a continuation of U.S. application Ser. No. 14/186,886, filed Feb. 21, 2014, now U.S. Pat. No. 9,630,684, which is a continuation of U.S. application Ser. No. 13/305,365, filed Nov. 28, 2011, now U.S. Pat. No. 8,657,640, which is a continuation of U.S. application Ser. No. 12/788,473, filed May 27, 2010, now U.S. Pat. No. 8,066,540, which is a continuation of U.S. application Ser. No. 11/139,493, filed May 31, 2005, now U.S. Pat. No. 7,727,038, which is a continuation of U.S. application Ser. No. 10/370,082, filed Feb. 21, 2003, now U.S. Pat. No. 6,971,936, each of the disclosures of which is incorporated herein by reference in its entirety.

FIELD OF THE INVENTION

The invention relates to collapsible flotation devices. More specifically, the invention is directed to a collapsible flotation device having a support member that allows a user to float thereon in a seated position.

BACKGROUND

Inflatable flotation devices are well-known, such as floats, rafts, lifeboats, life preservers, and other similar devices. Standard flotation devices generally maintain their shape by the air pressure of the device alone, and collapse when deflated. One example of a typical inflatable flotation device is the inflatable rescue raft described in U.S. Pat. No. 3,775,782 to Rice, et al. Like many other inflatable flotation devices that are commonly known, this inflatable rescue raft maintains its shape by way of its air pressure, and loses its shape when deflated, which allows the raft to be rolled, folded, or stored in a compact, deflated size.

More recently, collapsible flotation devices that use collapsible springs to assist in retaining the device's shape have become known. Because of the use of collapsible springs, less air may be used since air pressure is not entirely relied upon to maintain the device's shape. An example of a collapsible flotation device that makes use of collapsible springs to help maintain the device's shape and inflatable portions to provide buoyancy when used in water is described in U.S. Pat. No. 6,485,344 to Arias, the disclosure of which is incorporated herein by reference in its entirety. As is the case with many flotation devices, the flotation device of the Arias patent is generally used by a person in a laying or prone position.

It would be desirable to provide a collapsible flotation device with all of the attendant advantages of known collapsible flotation devices, which would have the added advantage of being easily used by a user in a seated position. Having a collapsible flotation device that is configured to be used in a seated position would be desirable for many activities in which a laying or prone position is less advantageous.

SUMMARY

A collapsible device provides a panel with an inner portion and an outer portion. A spring is disposed about the outer portion of the panel and is movable between a coiled configuration and an uncoiled configuration. A support member that traverses the panel is also provided. An inflatable bladder is disposed about at least a part of an outer portion of the panel, and is disposed proximate to the support member. The inflatable bladder is configured to buoyantly support the body weight of a user disposed on the panel.

Further features of the invention, and the advantages offered thereby, are explained in greater detail hereinafter with references to specific embodiments illustrated in the accompanying drawings, wherein like elements are indicated by like reference designators.

DETAILED DESCRIPTION

Figure 1:
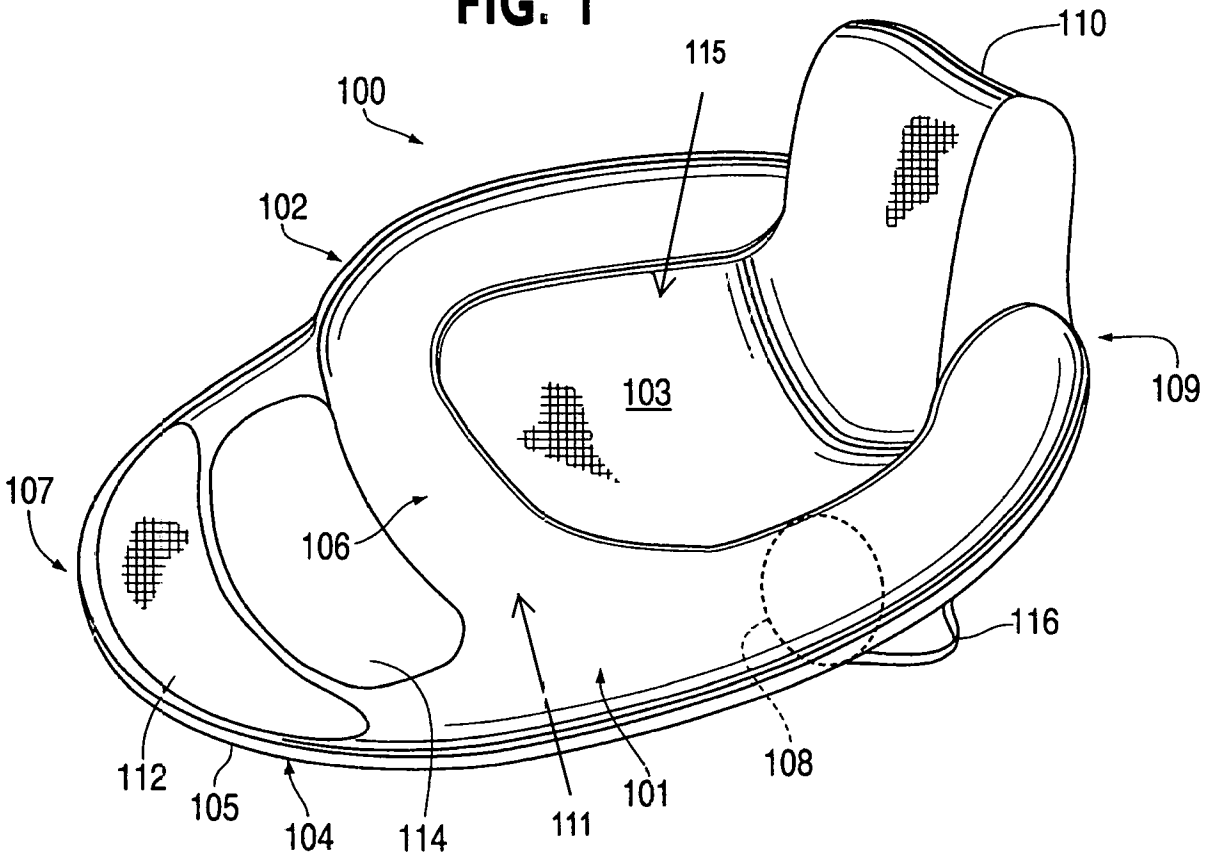
FIG. 1 is a perspective view of a collapsible flotation device, in accordance with an embodiment of the invention.

To facilitate an understanding of the principles and features of the invention, it is explained hereinafter with reference to its implementation in illustrative embodiments. In particular, the invention is described in the context of a collapsible flotation device configured to support a user, or multiple users, in a seated position. Various configurations are disclosed herein, each of which is considered to be encompassed within embodiments of the invention. Each of these configurations and embodiments are designed to support a user in a seated position while floating on water.

Multiple embodiments of collapsible flotation devices are disclosed that are configured to allow a user, or users, to remain in a seated position while floating on water. Generally speaking, the various embodiments of the invention allow a user, or users, to buoyantly float near the surface of the water, while only a portion of the user's body is submerged within the water.

The various collapsible flotation devices of the invention are formed from a panel including an inner portion and an outer portion, and a spring disposed about the outer portion of the panel, the spring being movable between a coiled configuration and an uncoiled configuration. The spring operates to change the shape of the flotation device. The spring can be a coiled, or folded upon itself, causing the collapsible flotation device to assume a collapsed configuration, which generally occupies less space and can be advantageous for storage. When the spring is uncoiled, the collapsible flotation device unfolds into its expanded configuration for use, in which it occupies more space. According to embodiments of the invention, the spring may be disposed within a sleeve that is disposed about the outer portion of the panel.

The panel according to embodiments of the invention is a device that may take on various shapes and forms, and is not necessarily flat (i.e., can be non-planar). In accordance with embodiments of the invention, the panel may define an extended region, and may be formed from flexible or semi-flexible materials, such as textiles, membranes (e.g., a flexible membrane), or the like. The outer portion of the panel (e.g., the outer portion of the flexible membrane) includes the panel's perimeter as well as some portion within the perimeter. The panel has an interior portion that does not include the perimeter or the outer portion of the panel. According to various embodiments of the invention, the interior portion may be disposed proximate to the outer portion. The interior portion can include multiple portions, including but not limited to an inner portion, a seating area, or the like. In accordance with some embodiments of the invention, the outer portion of the panel can include one or more buoyant members (e.g., an inflatable bladder, an inflatable member), one or more support members (e.g., a spring, rigid support member, or semi-rigid member), one or more foot support members, one or more back support members, and so forth, and the interior portion of the panel may include an inner portion, a seating area, a support member, a hole or opening, and so forth. Alternatively, according to other embodiments of the invention, elements associated above with the outer portion of the panel may be associated with the interior portion of the panel, and elements associate with the interior portion may be associate with the outer portion of the panel.

The various embodiments of the invention make use of a support member that traverses the panel of the flotation device. This support member can provide the support required to allow a user to remain in a seated position while floating on water. An inflatable bladder is disposed about at least a part of the outer portion of the flotation device's panel (e.g., such that the bladder forms a partial loop or a closed loop about the outer portion), and is coupled to the support member. Such a closed loop can have an interior 122 in FIG. 2. The inflatable bladder is configured to buoyantly support the body weight of a user on the panel, and the combination of this inflatable bladder and the support member is configured to support a user in a seated position on the panel, while floating in or on water. A back support, which may be inflatable and which may include a portion (e.g., a first portion 184) of the inflatable bladder as described herein, is also provided in connection with embodiments of the invention. The back support can be configured to support a user in a seated position in combination with the inflatable bladder and the support member, which can include a portion of the inflatable bladder as described herein.

Because of the positioning of the support member, and the inflatable bladder coupled thereto, a user can easily sit on the panel, and need not remain in a lying or prone position. The collapsible flotation device of the invention can be configured in a variety of shapes and designs to provide maximum utility. In accordance with an embodiment of the invention, the flotation device is an oval or elliptical shape. In accordance with other embodiments of the invention, however, the flotation device of the invention can comprise a variety of shapes including, but not limited to, elliptical, circular, rectangular, triangular, diamond-shaped, hourglass shaped, and so forth.

The collapsible flotation device of the invention may also make use of a variety of configurations to provide maximum utility to a user. For example, the flotation device may make use of multiple inflatable bladders instead of a single bladder. Additional bladders can be added to provide additional buoyancy, seating position support, adjustable back support, headrest support, and so forth. For example, an inflatable foot support member, upon which a user's feet may be rested, is provided according to embodiments of the invention. According to other embodiments of the invention, an inflatable headrest may be provided. Additionally, the back support may be configured to recline at various angles associated with various levels of inflation of the back support. Various pockets, straps, coverings, containers, valves, mechanical devices, and so forth are also used in connection with the collapsible flotation device according to various embodiments of the invention to provide a user with a variety of desired functionalities.

The flotation device of the invention can be constructed from a variety of different materials. For example, the panel (e.g., a flexible membrane, as described herein) may be made from a water permeable material, such as a mesh or similar material, which allows for a user disposed thereon to be seated partially within the water upon which the flotation device is floating. Water impermeable material may be used to protect portions or components of the flotation device that are sensitive to water exposure.

In accordance with embodiments of the invention, the collapsible flotation device may be configured to allow more than one user to be supported thereon. Specifically, the shape of the flotation device can be altered such that it provides sitting areas for multiple users. Alternatively, one or more flotation devices configured to support a single user can be connected by way of a connecting portion.

Figure 2:
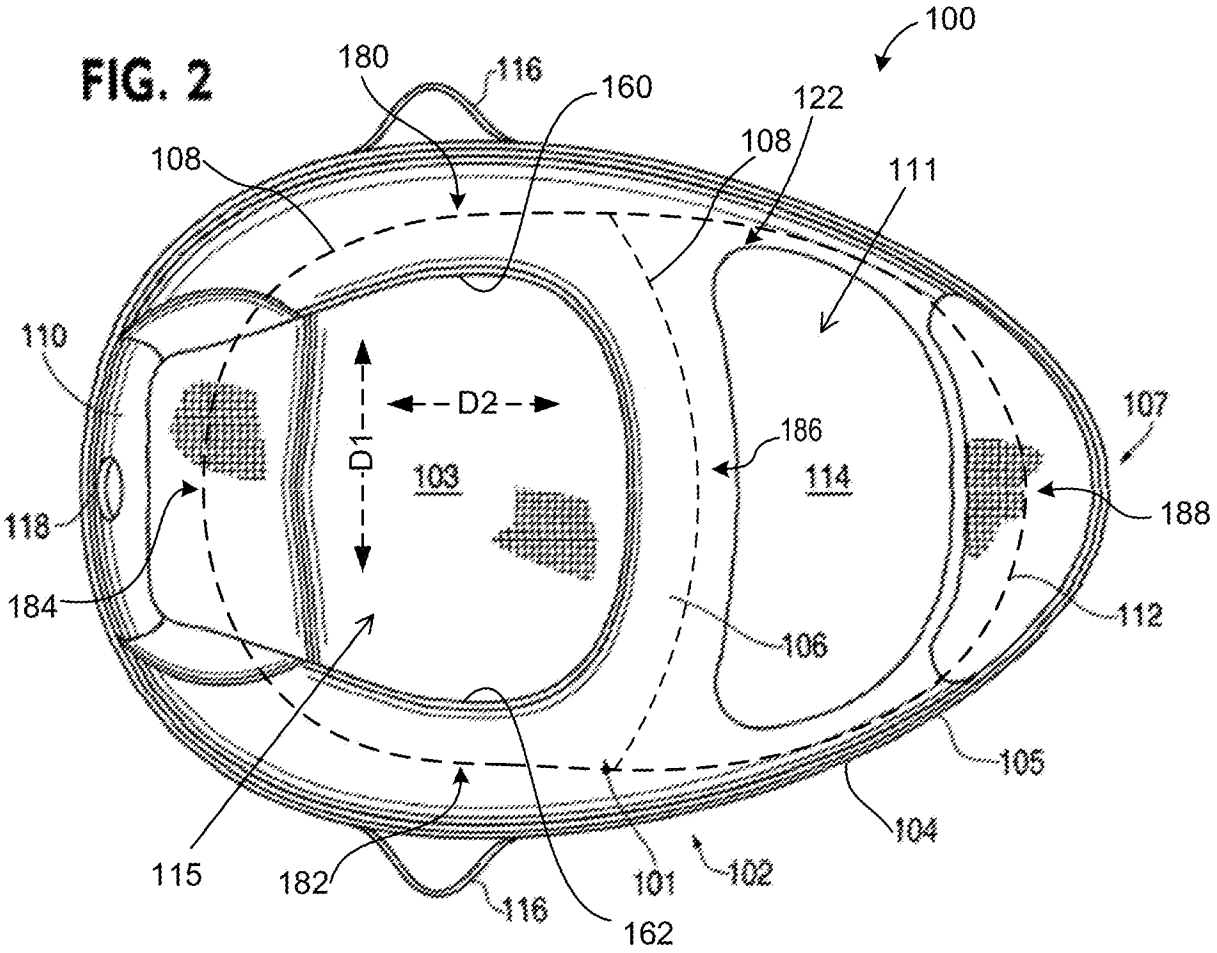
FIG. 2 is a top view of a collapsible flotation device, in accordance with an embodiment of the invention.

An example of a collapsible flotation device 100 according to an embodiment of the invention is shown in FIG. 1 in a perspective view. The flotation device 100 includes a panel 102 that has an outer portion 101 and an interior portion 111. The outer portion 101 may include, for example, a sleeve 105, one or more inflatable bladders 108, a back support member 110, and a foot support member 112, or portions of the panel proximate thereto. The interior portion 111 may include, for example, an inner portion 103 (e.g., a seating area), a support member 106, a headrest (not shown in FIG. 1), a hole 114, or portions of the panel proximate thereto or proximate to the back support member 110 or the foot support member 112. As shown in FIG. 2, the inner portion 103 has a first edge 160 and a second edge 162 on an opposite side of the inner portion from the first edge. A distance between the first edge 160 and the second edge 162 of the inner portion 103 defines a width of the inner portion 103. As also shown in FIG. 2, the inflatable bladder (or inflatable member) 108 has opposing portions (e.g., a fourth portion 180 and a fifth portion 182, according to an embodiment, or a first portion 184 and a second portion 186, according to an embodiment). The first portion 184 of the inflatable bladder 108 and the second portion 186 of the inflatable bladder are disposed at opposite sides, respectively, of the inner portion 103, and the fourth portion 180 and the fifth portion 182 of the inflatable bladder are disposed at opposite sides of the inner portion 103. Thus, the inner portion 103 is disposed across an opening or hole 115 of the inflatable bladder 108 in a first direction (represented by arrow D1 in FIG. 2), e.g., a direction between the first and second portions of the inflatable bladder. The inner portion 103 is also disposed across the opening of the inflatable bladder 108 in a second direction (represented by arrow D2 in FIG. 2) perpendicular to the first direction, e.g., a direction between support member 106 and the back support member 110, as shown in FIG. 2.

A rigid support member, or shape-retaining member, 104 (e.g., a coilable spring) is disposed about the outer portion 101 of the panel 102. According to an embodiment of the invention, the rigid support member 104 may be, for example, a permanently rigid or semi-rigid member. Alternatively, the rigid support member 104 may be a coilable spring configured to change between a coiled and an uncoiled position.

As illustrated in FIG. 1, the inner portion 103 of the panel 102 may be constructed from a material (e.g., a first material) that is different than the material (e.g., a second material) of the outer portion 101 of the panel 102. For example, in accordance with an embodiment of the invention, the inner portion 103 of the panel 102 could be a membrane made from a mesh (e.g., a mesh membrane), or similar material, (e.g., a first material), while the material of the outer portion 101 of the panel 102 could be a nylon, or other suitable material (e.g., a second material). As shown in FIGS. 1 and 2, the back support member 110 can be at least partially formed of such a mesh or mesh membrane. When the flotation device 100 has a user seated thereon, the inner portion 103 of the panel 102 is partially submerged in water. Therefore, using a mesh, or other similar material, water can freely pass, thereby partially submerging a user seated in the inner portion 103 of the panel 102.

The coilable spring 104 provides rigidity to the flotation device 100 while the flotation device 100 is in an expanded configuration. Advantageously, however, the coilable may be folded upon itself, or coiled, into a coiled configuration, thereby collapsing the flotation device 100 into a space-saving collapsed configuration. According to embodiments of the invention, the coilable spring 104 may be disposed within a sleeve 105, which is disposed about the outer portion 101 of the panel 102.

An example of a coilable spring used for rigidity in a collapsible device, and the technique of transforming a collapsible device between a collapsed configuration and an expanded configuration can be seen in U.S. Pat. No. 6,170,100 to Le Gette et al., the disclosure of which is incorporated by reference herein in its entirety. The coilable spring used in connection with the flotation device 100 generally has an elongated cross section, such as a rounded rectangular cross section, that provides rigidity in the plane of the coilable spring when uncoiled, but which allows the spring to be folded onto itself. The Le Gette et al. patent illustrates the manner in which the collapsible flotation device 100 of the invention can be folded to a collapsed configuration for storage, or to minimize the space that it occupies.

The coilable spring 104 of the flotation device 100 has a generally rounded, or circular shape when uncoiled. The spring 104 can be coupled to the panel 102 (e.g., by way of a sleeve 105, etc.) in such a manner that the shape of the panel 102 changes the shape of the spring 104. Thus, when the panel 102 is an oval shape, the spring 104 takes on an oval-like shape to support a generally oval-shaped device 100. The sleeve 105 is shown circumscribing the outer portion 101 of the panel 102, although the sleeve 105 may be located in a variety of locations.

The flotation device 100 also has a support member 106 that traverses the panel 102. In the embodiment illustrated in FIG. 1, the support member 106 is located at approximately one-third of the distance from the foot end 107 of the flotation device 100. However, it will be appreciated that the precise location of the support member 106 may be varied, according to various design parameters and objectives. For example, to allow a user to be seated within the inner portion 103 of the panel 102, the location of the support member 106 may vary according to the anticipated girth of the user. Moreover, the support member 106 can be adjustable, removable, and attachable, in accordance with embodiments of the invention.

An inflatable bladder is disposed about at least a part of the outer portion of the panel 102, and is coupled to the support member 106. A cross-section of the inflatable bladder 108 is shown by a broken line (see, e.g., FIG. 1) as being contained within the outer portion 101 of the panel 102. According to embodiments of the invention, the inflatable bladder 108 can also be contained within the support member 106. The portion (e.g., second portion 186) of the inflatable bladder 108 contained within the support member 106 is elongate and, because the support member 106 traverses the panel, traverses the closed loop of the inflatable bladder. Thus, the inflatable bladder 108 forms a substantially oval-shape (forming, for example, the closed loop) or U-shape. The inflatable bladder 108 defines the hole or opening 115 (e.g., a first opening) within its shape (e.g., within the closed loop, and over which the inner portion 103 of the panel 102 (e.g., flexible membrane) is disposed, as shown in FIGS. 1-2). In this manner, the flexible membrane (e.g., at inner portion 103) is disposed within the first opening 115. As shown in the embodiment in FIGS. 1-2, the inner portion 103 entirely extends throughout the opening 115. The exact shape of the bladder may vary according to various embodiments of the invention, and can include a closed loop. The inflatable bladder may be made up of multiple inflatable portions, or multiple inflatable bladders. The inflatable bladder 108 is configured to buoyantly support the body weight of a user. When used in combination with the support member 106 and the back support member, the inflatable bladder is configured to support a user in a seated position on the panel 102. To further provide support to a user in a seated position, the inflatable bladder 108 may be shaped in such a way to provide some support to a user's back.

In contrast to known collapsible flotation devices, the device 100 shown in FIG. 1, as well as the devices according to the alternative embodiments of the invention, allow a user to easily remain in a seated position while floating on water because of the location of the support member 106. Specifically, when a user is seated on an inner portion 103 of the panel 102, the relative proximity of the support member 106 to the user's rear end supports the user's legs, and in combination with the inflatable bladder 108, allows a user to remain in a seated position.

The collapsible flotation device 100 illustrated in FIG. 1 also makes use of a back support member 110. This back support member 110 provides additional support for a user to remain in a seated position on the inner portion 103 of the panel 102. In the particular embodiment illustrated in FIG. 1, the back support member 110 is inflatable. Alternatively, the back support member 110 can have a variety of configurations relative to the panel 102, thereby providing adequate support for a user to remain in a seated position. In embodiments where the back support member 110 is inflatable, it can be inflated by a separate inflatable bladder. In another embodiment, the inflatable bladder 108 can also be shaped so that it also inflates within the back support member 110. In yet another embodiment, the back support member can be inflated by an inflatable bladder portion (or back support portion) integrally formed with bladder 108. The back support member 110 can be shaped so that it supports a user's back, while the user is in an upright-seated position and the user's head, while the user is in a reclined position between an upright-seated position and a prone position. Additionally, the back support member 110 can be inflatable to different levels to provide a plurality of reclining support levels.

The collapsible flotation device 100 illustrated in FIG. 1 also has other convenient features. One such feature is a foot support member 112 located at the foot end 107 of the flotation device 100 opposite the head end 109. In accordance with an embodiment of the invention, the foot support member 112 may be inflatable or otherwise buoyant. The foot support member can alternatively be made from a cushioning material to provide a comfortable footrest for a user seated on the panel 102. In embodiments where the foot support member 112 is a cushion, it may be made, for example, from foam, or other suitable material that is able to be used or that floats in water. It may be desirable to make the foot support member from a material that is resistant to water damage. In embodiments where the foot support member 112 is inflatable, it may be inflated by using a separate inflatable bladder, or by connecting the inflatable bladder 108 (e.g., a portion 188, such as a third portion, of inflatable bladder 108, as shown in FIG. 2), or another inflatable bladder in the device 100, to the foot support member 112 to provide air pressure within the foot support member 112. In this matter, the inflatable bladder, when connected to the foot support member 112 to provide air pressure within the foot support member 112, forms a closed loop about the shape of the flotation device.

According to an embodiment of the invention, the foot support member may be attached to the flotation device 100 by some means other than the panel 102 or the spring 104. For example, the foot support member 112 can be attached to the flotation device 100 by way of a rigid support member (e.g., plastic rods, etc.), or by way of a non-rigid connection device (e.g., tethers). When attached by a rigid support member, the foot support member 112 would not need to be buoyant; however, in the case of a non-rigid connection device, the foot support member 112 would likely need to be buoyant.

The collapsible flotation device 100 illustrated in FIG. 1 shows a configuration in accordance with an embodiment of the invention that has a hole or opening 114 (e.g., a second opening), through which water may pass or a user may place the user's legs (e.g., the hole 114 is sized to receive the user's legs therethrough). As shown in FIG. 1, the hole 114 is defined by and disposed between the foot support member 112 and the support member 106. The inclusion or placement of such a hole 114 is subject to a variety of design parameters and objectives. Accordingly, the invention is intended to encompass collapsible flotation devices with or without such holes, or with holes shaped differently, or placed in different locations, than the hole 114 shown in FIG. 1. The presence of an foot support member 112 is entirely optional, as the foot support member 112 could be removed, allowing the hole 114 to be larger and more easily accommodate a user's legs.

Additionally, numerous optional elements can be added to the collapsible flotation device 100 illustrated in FIG. 1, in accordance with various embodiments of the invention that are intended to be embraced within the scope of the inventions. Many of these elements will be illustrated in the various figures. One such element is a strap 116, which is provided, for example, for convenience in removing the device 100 from the water and carrying or transporting the collapsible flotation device 100. While many such features will be illustrated in the drawings and described below, some will not be illustrated, but will merely be described. The invention is intended to embrace those elements shown in the drawings and described below, as well as some items not shown, but readily added.

Figure 3:
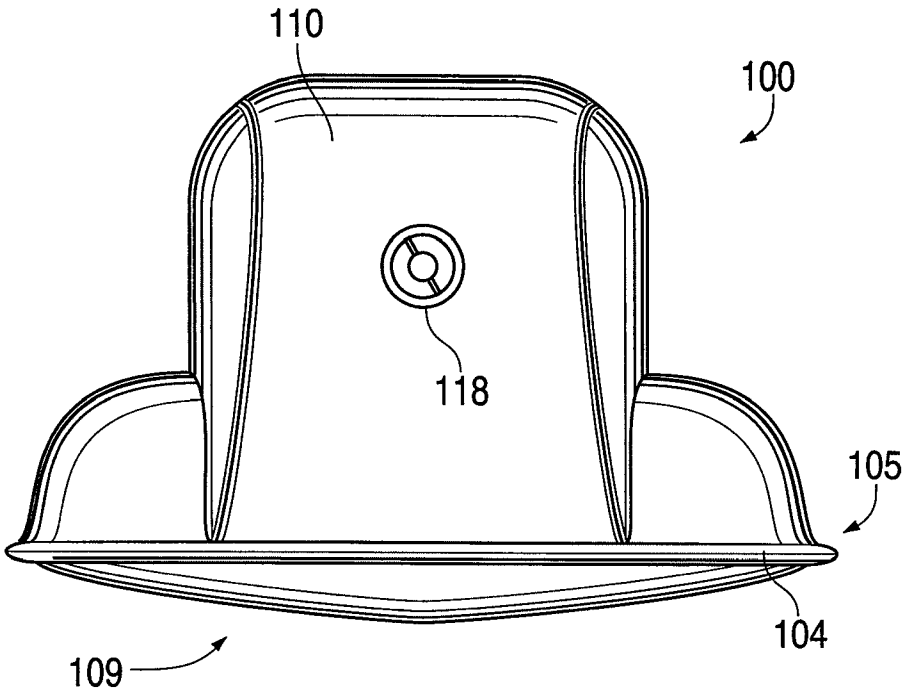
FIG. 3 is a back view of a collapsible flotation device, in accordance with an embodiment of the invention.

FIG. 2 is a top view of the collapsible flotation device 100 illustrated in FIG. 1. This top view illustrates many of the same elements described in connection with FIG. 1. Additionally, the top view provides a better angle for viewing various shapes associated with the embodiment of the invention illustrated therein. In addition to features described in connection with FIG. 1, an inflation valve 118 can be seen in FIG. 2, and more clearly in the back view of the flotation device 100 illustrated in FIG. 3.

The inflation valve 118 may be a variety of suitable valves. For example, a standard oral inflation valve could be used, whereby a user could inflate the bladder within the back support member 110 orally. Additionally, other types of valves could be used, such as one-way valves, valves configured to be used with pumps, or other suitable valves. It should be noted that, in addition to inflating the back support member 110, the valve 118 could be used to inflate the inflatable bladder 108 in embodiments where the inflatable bladder 108 is shaped to also provide air pressure within the back support member 110. Alternatively, in an embodiment wherein the back support member 110 has a separate inflatable bladder from the inflatable bladder 108, the valve location could house multiple valves to inflate these multiple inflatable bladders. Although the valve 118 is shown in a specific location, the valve, or a plurality of valves, can be located anywhere on the device 100 according to various preferences.

Figure 4:
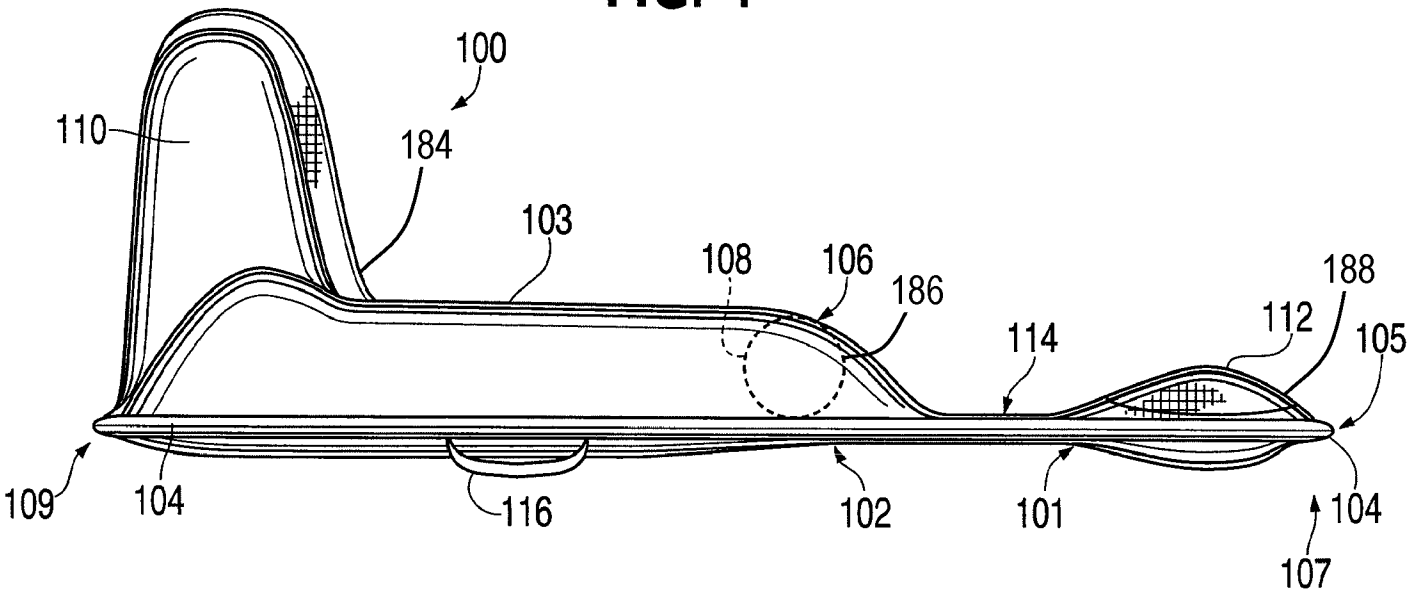
FIG. 4 is a side view of a collapsible flotation device, in accordance with an embodiment of the invention.
Figure 4A:
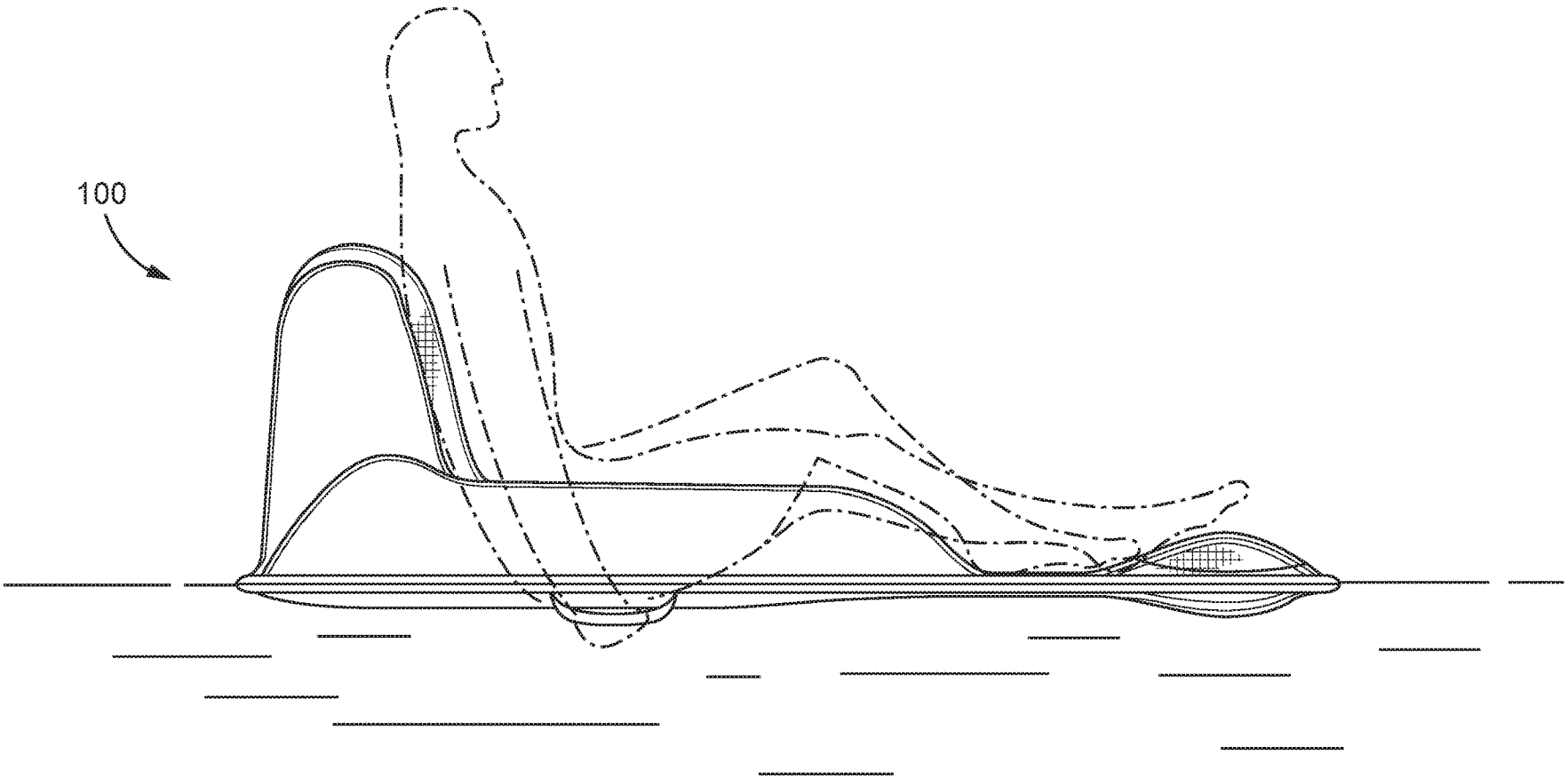
FIG. 4A is a side view of the collapsible flotation device of FIG. 4, depicting the device on water and a user seated thereon such that the user is partially submerged in the water.

FIG. 4 is a side view of the collapsible flotation device 100. This view illustrates many of the same features shown in FIGS. 1-3. Additionally, the broken line 108 illustrates a cross-section of a portion of the inflatable bladder 108 (e.g., a second portion 186, in reference to the inflatable bladder forming the closed loop and disposed about the outer portion of the panel, or in reference to a first portion 184 of the inflatable bladder in the back support member 110 and a third portion 188 of the inflatable bladder connected to the foot support member 112) where the inflatable bladder 108 passes through the support member 106.

Figure 5:
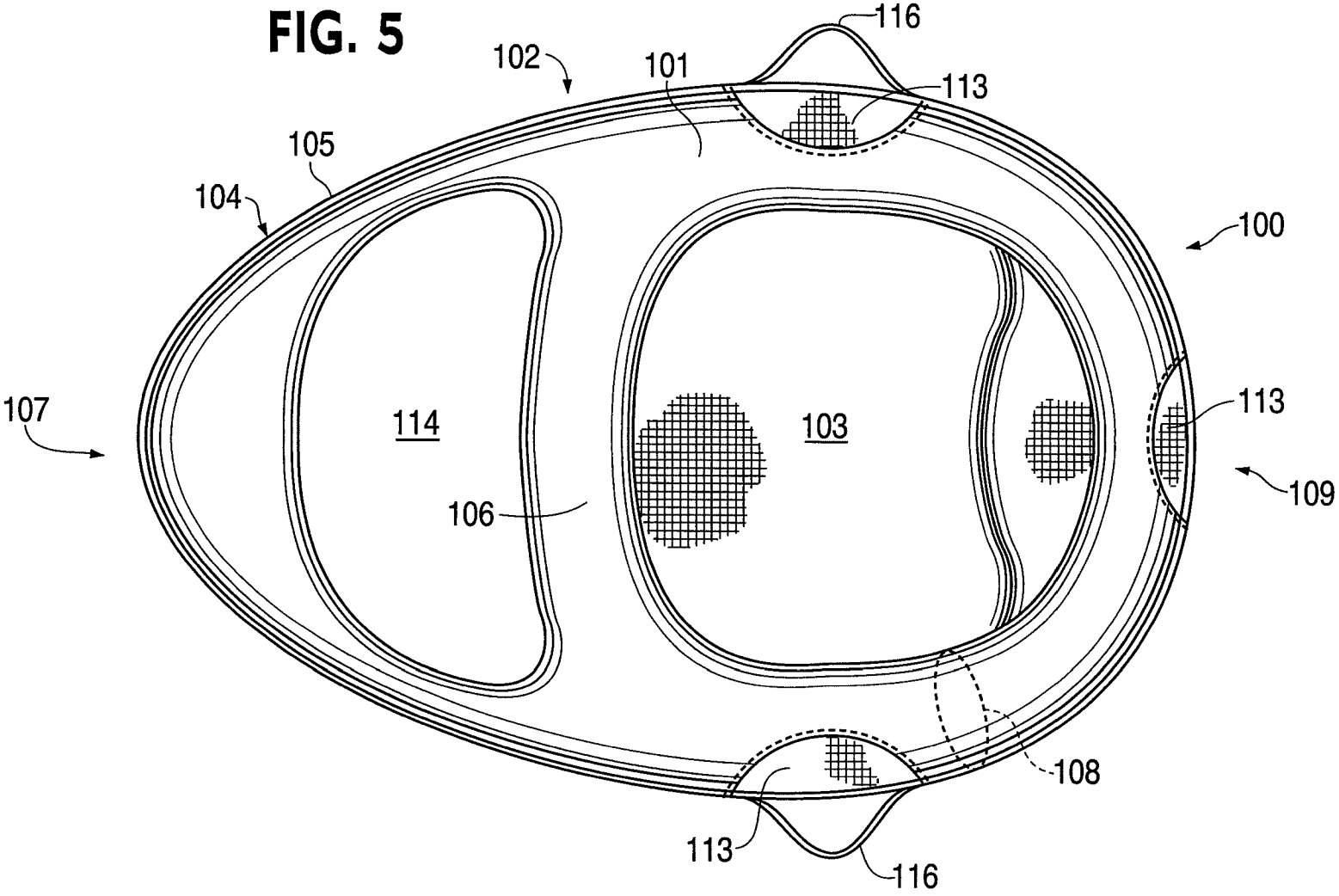
FIG. 5 is a bottom view of a collapsible flotation device, in accordance with an embodiment of the invention.

FIG. 5 is a bottom view of the collapsible floatation device 100 in accordance with an embodiment of the invention. Features illustrated in FIG. 5 can be used in connection with the various embodiments of the invention, and are not limited to the device 100. The bottom view shown in FIG. 5 shows drain areas 113 that allow water to drain from within the panel 102 (e.g., from within the sleeve 105). Thus, water that accumulates within the device 100 as it is used in the water drains from the device 100 via the drain areas 113 as the device 100 is pulled from the water (e.g., by way of the handles 116). The drain areas may be made of any material suitable to allow the passage of water, such as a mesh or other porous material and can be located anywhere on the flotation device 100.

Figure 6:
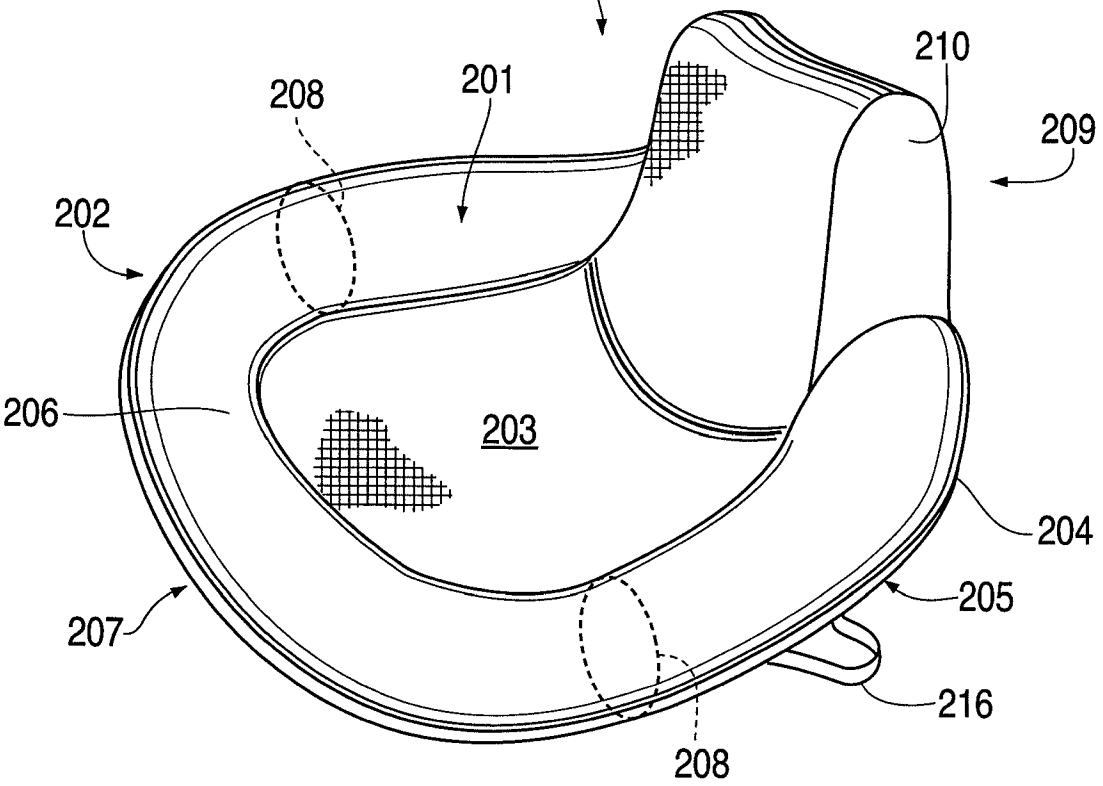
FIG. 6 is a perspective view of a collapsible flotation device, in accordance with an embodiment of the invention.

FIG. 6 is a perspective view of a collapsible flotation device 200, in accordance with another embodiment of the invention. This flotation device 200 differs from the flotation device illustrated in FIGS. 1-4, in that it does not have a foot support member at the foot end 207 of the panel 202. Like the flotation device 100 illustrated in FIGS. 1-4, however, the flotation device 200 also uses a panel 202 having an inner portion 203 and an outer portion 201, a spring 204, a support member 206, an inflatable bladder 208 (the cross section of which is represented by broken lines), and a back support member 210. According to an embodiment of the invention, the support member 206 and the inflatable bladder 208 form an integral piece. In other embodiments, the support member 206, the inflatable bladder 208, and the back support member 210 can form an integral piece (forming, for example, a closed loop). The spring 204 is disposed within a sleeve 205, which is disposed about the outer portion 201 of the panel 202. Other features can be provided associated with the flotation device 200 that are not shown, such as a pillow-shaped headrest, pockets, and so forth.

The flotation device 200 of FIG. 6 provides similar support for a user in a seated position to the flotation device 100 illustrated in FIGS. 1-4 by way of the support member 206, the inflatable bladder 208, and the back support member 210. By way of the combination of the support member 210 positioned at the head end 209 of the panel, the inflatable bladder 208, and the back support member 210, a user can remain comfortably seated within the inner portion 203 of the panel 202 while the flotation device 200 floats in water. The height of the back support member can be adjusted either by way of differing inflation amounts or otherwise, according to a user's comfort preferences. Additionally, a handle 216 is provided for convenience in removing the device 200 from the water or carrying the device.

Figure 7A:
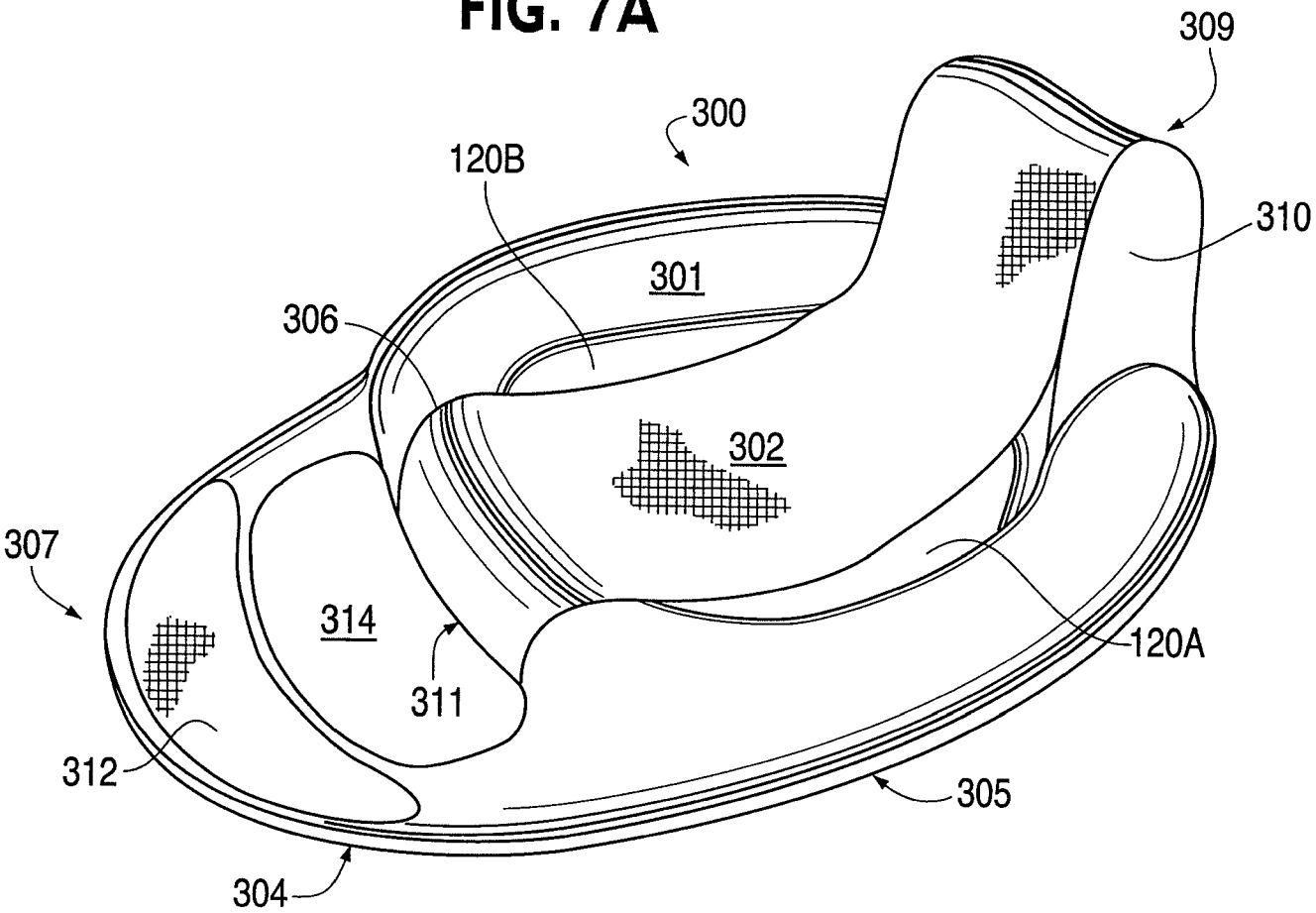
FIG. 7A is a perspective view of a collapsible flotation device, in accordance with an embodiment of the invention.
Figure 7B:
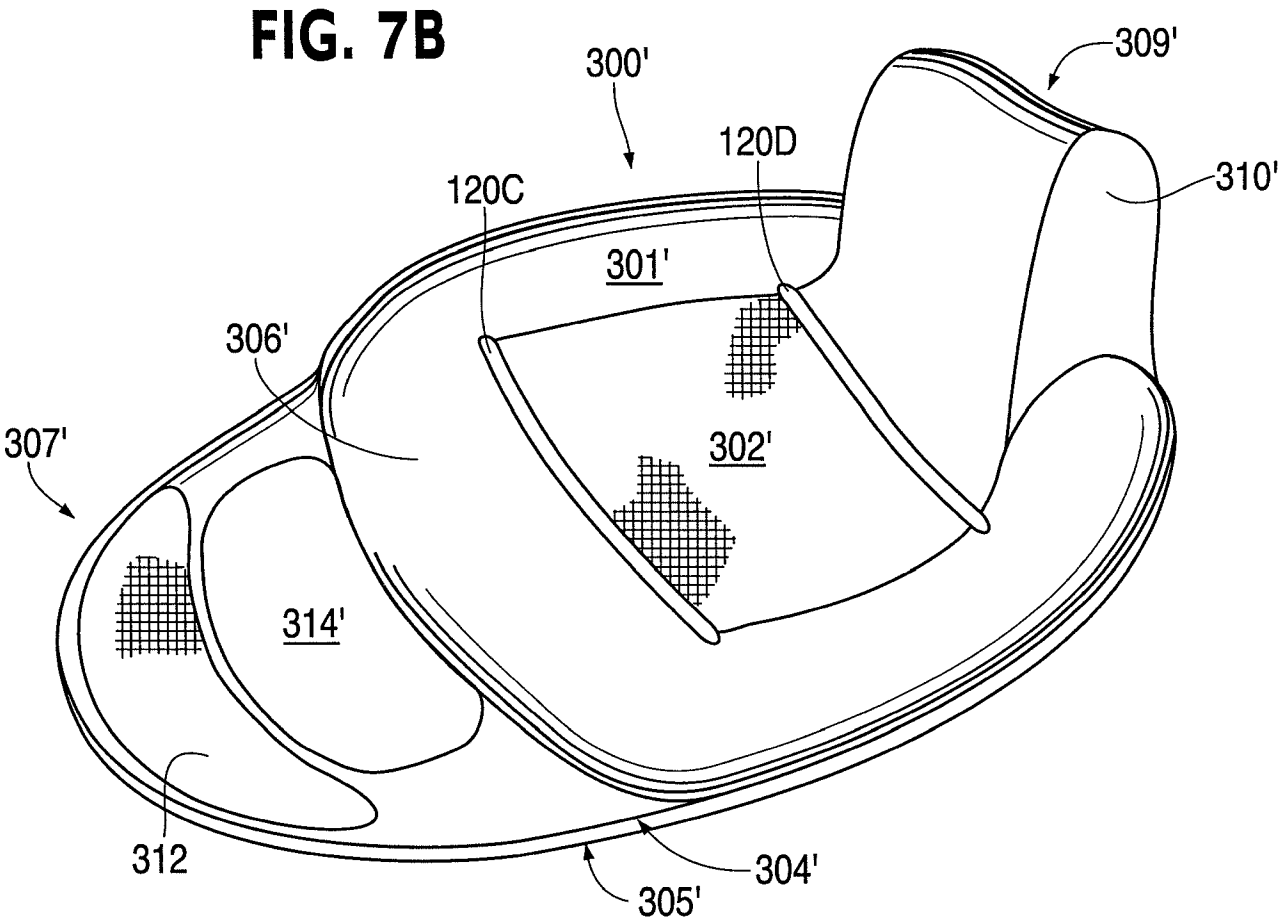
FIG. 7B is a perspective view of a collapsible flotation device, in accordance with an embodiment of the invention.

FIGS. 7A and 7B are perspective views of collapsible flotation devices in accordance with embodiments of the invention. The flotation device 300, 300' is similar to the flotation devices 100 and 200 described above. The flotation device 300, 300' is a chair including a seat portion 301, 301' and a membrane 302, 302'. The membrane 302, 302' has a first and a second end (or edge), each of the ends (or edges) being coupled to one of the seat portion 301, 301' and the back portion 310, 310'. The spring 304, 304', which may be disposed within a sleeve 305, 305', is coupled to at least a part of the seat portion 301, 301' of the chair 300, 300'.

The embodiments of the flotation device 300, 300' illustrated in FIGS. 7A and 7B provide a somewhat suspended, hammock-like membrane 302, 302' within a seating area, about which the seat portion 301, 301' is disposed. When a user is seated on the membrane 302, 302', and the flotation device 300, 300' is on water, water is allowed to pass through the holes 120A, 120B, 120C, 120D, and the user remains partially supported by the membrane 302, 302' while being partially submerged in the water. Also provided is a footrest 312, 312' at the foot end 307, 307' of the device 300, 300'.

The flotation device shown in FIG. 7A has a membrane 302, which is coupled to a section 311 of the seat portion 301 and the back portion 310 located at a head end 309 of the device 300. In this manner, the membrane 302 is oriented in a first direction. The membrane 302 is shown as being coupled to the back portion 310 at the top of the back portion; however, the membrane can be attached to the back portion 310 along any part of the back portion 310. Additionally, the end of the membrane 302 coupled to opening the back portion 310 can be coupled to both the back portion 310 and the seat portion 301 proximate to the back portion 310. The flotation device shown in FIG. 7B has a membrane 302' that is oriented in a different (e.g., second) direction, and is coupled to two locations of the seat portion 301'. Although the membrane 302' is not shown as coupled to the back support member 310' in FIG. 7B, according to another embodiment of the invention it can be coupled to two locations of the seat portion 301' and to the back support member 310'. Alternatively, the membrane 302' could be attached to multiple locations of the seat portion 301'. For example, according to an embodiment of the invention, the membrane 302' could be attached to 3 locations of the seat portion 301' (e.g., the two locations shown, and a third location opposite the back portion 310').

Figure 8A:
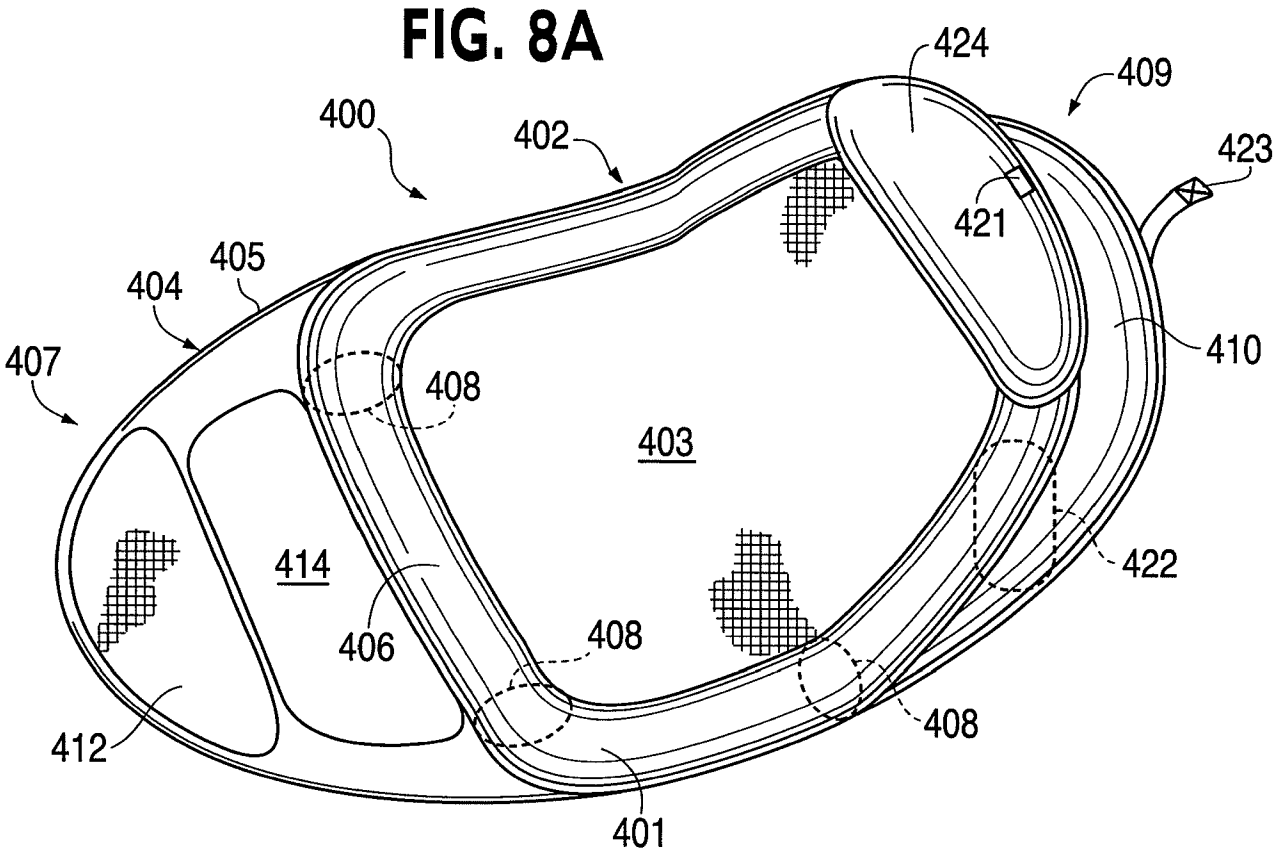
FIG. 8A is a perspective view of a collapsible flotation device, showing an inflatable bladder, in accordance with an embodiment of the invention.
Figure 8B:
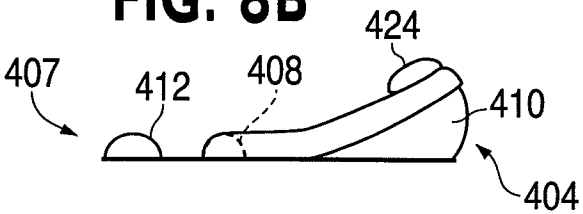
FIG. 8B is a side view of a collapsible flotation device, in accordance with an embodiment of the invention.
Figure 8C:
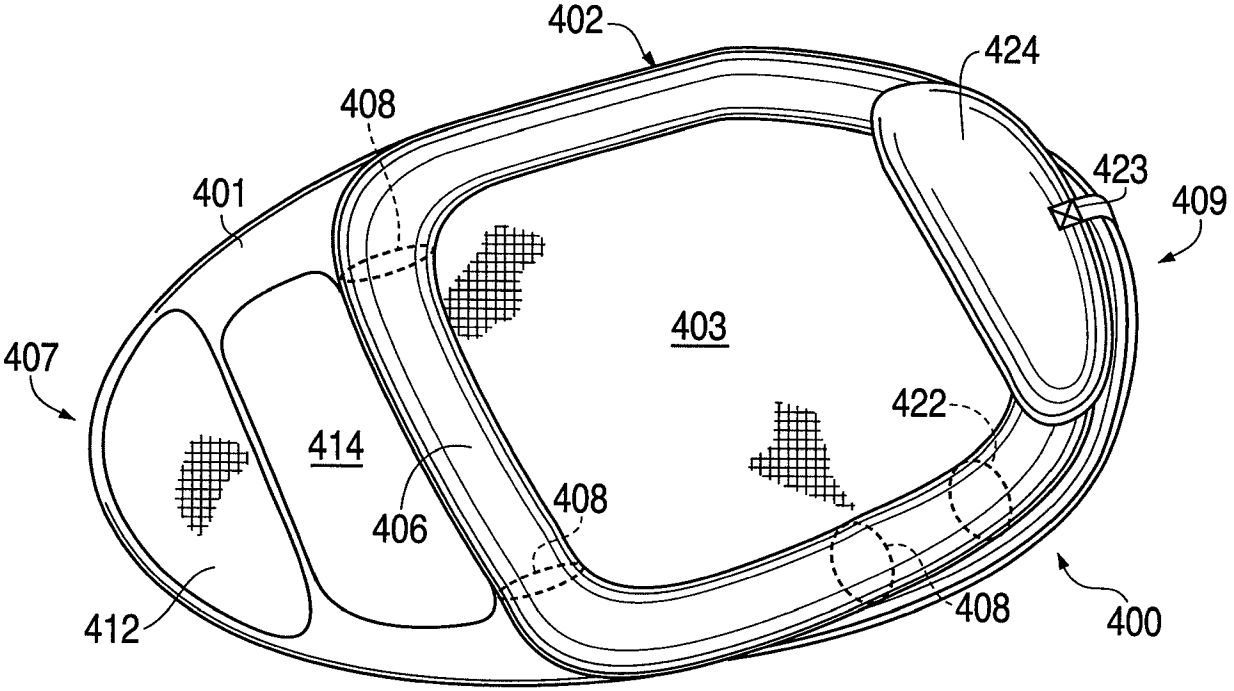
FIG. 8C is a perspective view of a collapsible flotation device, showing an inflatable bladder, in accordance with an embodiment of the invention.
Figure 8D:
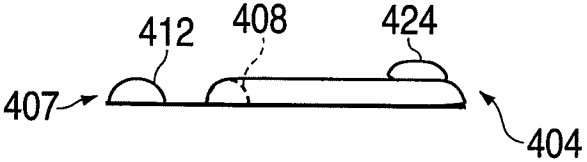
FIG. 8D is a side view of a collapsible flotation device, in accordance with an embodiment of the invention.

FIGS. 8A-D illustrate a flotation device 400 that provides a user support in a variety of reclined seating positions, being able to move between a range of seated positions, (e.g., between a first position and a second position), ranging from an upright seated position (e.g., one of the first position or the second position) to a prone position (e.g., the other of the first position or the second position). Thus, the flotation device can move between a first configuration corresponding to an upright-seated position to a second configuration corresponding to a prone position. FIG. 8A is the perspective view and FIG. 8B is a side view of the flotation device 400 with the back support member 410 being in a partially reclined position (e.g., a second position). FIG. 8C is a perspective view and FIG. 8D is a side view of the flotation device with the back support member 410 in a fully reclined, or prone position (e.g., a first position).

FIG. 8A shows a perspective view of the flotation device 400 with the back support member in a partially reclined position. The inflatable bladder 408 is shown by way of a series of broken lines. This illustration shows that the inflatable bladder is disposed about at least a part of the outer portion 401 of the panel 402, and is coupled to the support member 406 (i.e., in this embodiment it is disposed within the support member 406). Additionally, the location of an additional inflatable bladder 422, used to inflate the back support member 410, is illustrated by way of a broken line. As this additional inflatable bladder 422 is inflated, the position of the back support member 410 is changed such that a user may be supported in a variety of reclined seating positions, as well as the upright seated and prone positions. As the bladder 422 within the back support member 410 becomes increasingly inflated, the back support member 410 becomes less and less reclined, and a user approaches an upright seated position.

As discussed above, the back support member 410 may or may not be inflated by way of a separate bladder 422. In accordance with embodiments of the invention, the inflatable bladder 408 may be shaped such that it inflates portions of the panel 402 as well as the back support member 410.

Furthermore, the support member 406 may be inflated by way of the inflatable bladder 408, or by way of a separate support member inflatable bladder, which is represented by the broken lines shown within the support member 406.

A headrest 424 is shown as being coupled to the back support member 410. The headrest 424 may be attached to the back support member 410 in a variety of ways. For example, as will be discussed below, the headrest may be fixedly attached to the support member 410, or may be detachable. As discussed above, the back support member 410 can itself provide the basic function of a headrest when the user is seated in certain positions. The headrest 424 may, therefore, be considered to be an additional headrest, providing cushioning in addition to any headrest-like cushioning provided by the back support member 410.

FIG. 8C shows a perspective view of the flotation device 400 with the back support member in a fully reclined or prone position. This prone position is achieved by deflating the inflatable bladder 422 within the back support member 410. A range of reclined positions can be achieved by way of inflating the additional inflatable bladder 422, which can include a range between an upright-seated position and a prone position.

Although the configuration shown in FIGS. 8C and 8D most comfortably supports a user in a prone position, the combination of the support member 406 and inflatable bladder 408 can accommodate a user in a seated position. The flotation device 400 of FIGS. 8A-D also includes a foot support member 412 at the foot end 407, a hole 414 disposed between the support member 406 and the foot support member 412, and may include a sleeve 405 within which the spring 404 can be disposed. A connector 423 can be removably attached to a receptor 421 on the headrest 424 or the back support member 410 to secure the back support member 410 or the headrest 424, when the back support member 410 is deflated in the position shown in FIGS. 8C and 8D.

FIGS. 9A-E show perspective views of headrests 124 according to embodiments of the invention that may be used in connection with a variety of flotation devices. FIGS. 9A-E specifically show the various headrests 124 associated with the flotation device 100 shown in FIGS. 1-4; however, these headrests can also be used with the devices according any of the embodiments of the invention. Each of the headrests shown in FIGS. 9A-E provide support for a user's head in addition to any support provided by the back support member 110, as described above. The headrest 124 may be adjustable to a variety of positions and heights to support users of varying body shapes and with varying preferences. The headrest 124 may be a cushion (e.g., made from a foam or other suitable cushioning material) that can withstand use in or around water, or could be inflatable by way of an internal inflatable bladder. In the case of an inflatable headrest 124, the internal inflatable bladder may be inflated by way of a valve 126 separate from the valve 118 used to inflate the bladder associated with the back support member 110. This valve 126 may be of a variety of different types of valves, such as the types described above including, but not limited to, an oral inflation valve, a one-way inflation valve, or the like.

Figure 9A:
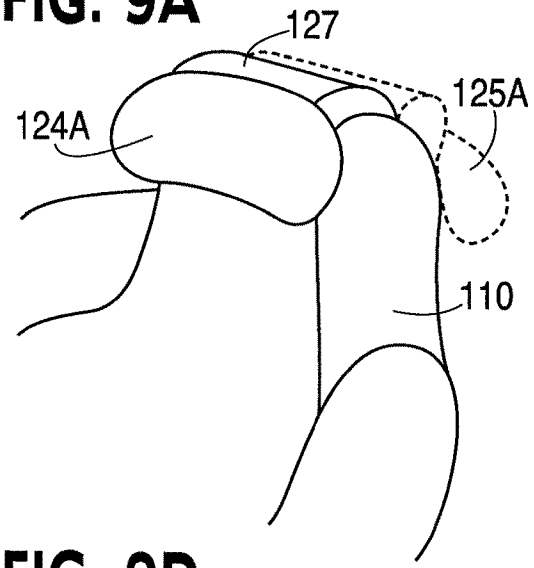
FIGS. 9A-E are perspective views of a headrests according to embodiments of the invention.

The headrest 124A shown FIG. 9A is attached with a piece of material 127 that allows the headrest to be moved to a second position 125A, indicated by broken lines, that is out of the way (i.e., behind the back support member 110). The material 127 may be fixedly attached to the back support member, or may be removable by way of one or more fasteners (e.g., hook-and-pile, snaps, etc.). The material 127 may be any suitable material for connecting the headrest 124A to the back support member 110. Additionally, the material 127 may be one or more individual pieces of material.

Figure 9B:
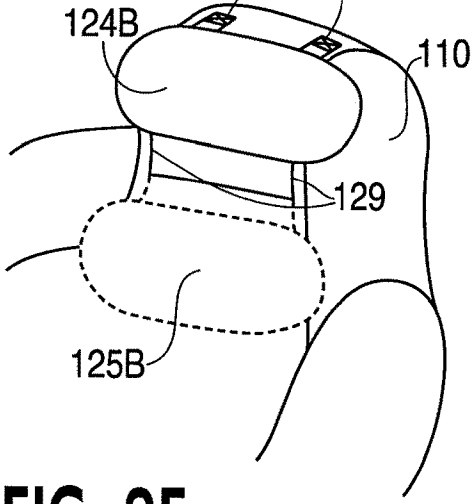

In FIG. 9B the headrest 124B is attached to the back support member 110 by way of one or more tethers 129. The tethers 129 may be made of any material suitable for attaching the headrest 124B to the back support member 110. The tethers 129 may be permanently or temporarily attached to the back support member in a variety of positions. When the tethers 129 are attached on the front of the back support member 110, as shown in FIG. 9B, the headrest 124B can move from the headrest position shown to a second position 125B, indicated by broken lines. The tethers 129 can be attached in such a manner that the second position 125B advantageously provides lumbar support, or support to another part of the back. When the headrest 124B is in the headrest position (i.e., the position shown in FIG. 9B), it can be temporarily secured to the back support member 110 by way of fasteners 131. The fasteners may include, for example, hook-and-pile, snaps, or the like.

Figure 9C:
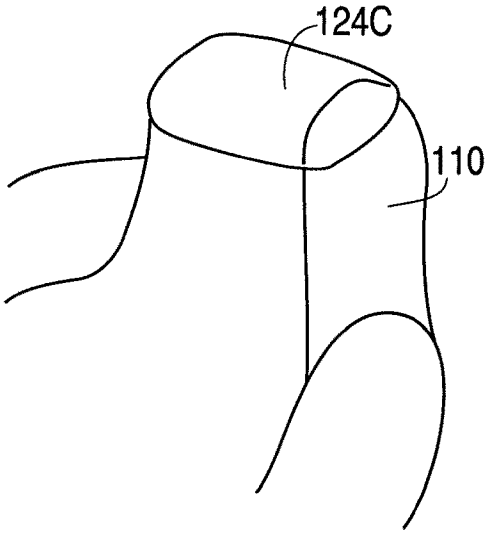

FIG. 9C illustrates an embodiment in which the headrest 124C is permanently attached to the back support member 110. In this embodiment, if the headrest 124C is inflatable, it may be inflated by way of a separate inflatable bladder separate from the bladder used to inflate the back support member. Alternatively, the headrest 124C may share an inflatable bladder with the back support member 110.

Figure 9D:
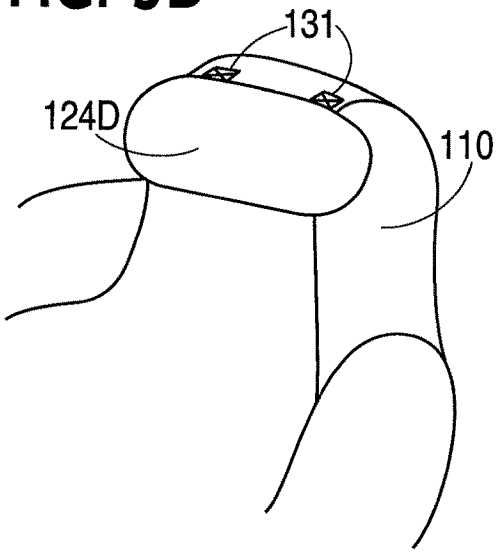

The headrest 124D shown in FIG. 9D is similar to the headrest 124C shown in FIG. 9C, and is removable. The headrest 124D is attached by way of fasteners 131 to the back support member. The fasteners 131 attach to fastening devices on the headrest itself (not shown), and may include, for example, hook-and-pile, snaps, and the like. Because the headrest 124D shown in FIG. 9D is removable, if it is inflatable, it must be inflated by way of a separate bladder separate from the bladder used to inflate the back support member.

Figure 9E:
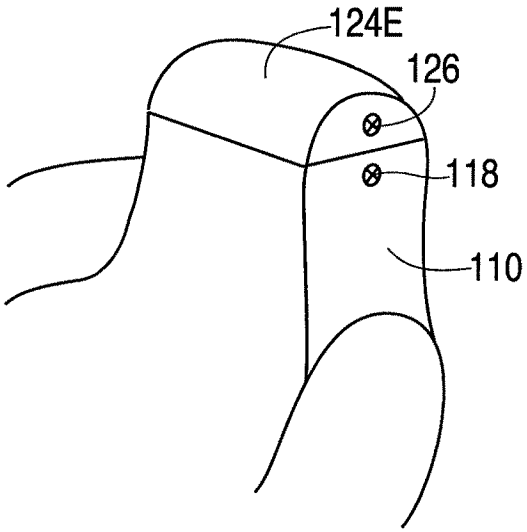

The headrest 124E shown in FIG. 9E is integrally formed as part of the back support member 110. The headrest 124E may be inflated by the same bladder used to inflate the back support member 110. Alternatively, the headrest 124E may be separately inflatable from the back support member, either by way of a separate inflatable bladder, or by way of a chamber of the bladder used to inflate the back support member 110. For example, the inflatable bladder used to inflate the back support member 110 may be inflated by way of the valve 118 shown on the back support member 110, while the headrest may be separately inflatable by way of the valve 126 shown on the headrest 124E. The placement of the valves 118, 126 is optional, as the valves could be placed in a number of suitable locations.

Figures 10A, 10B:
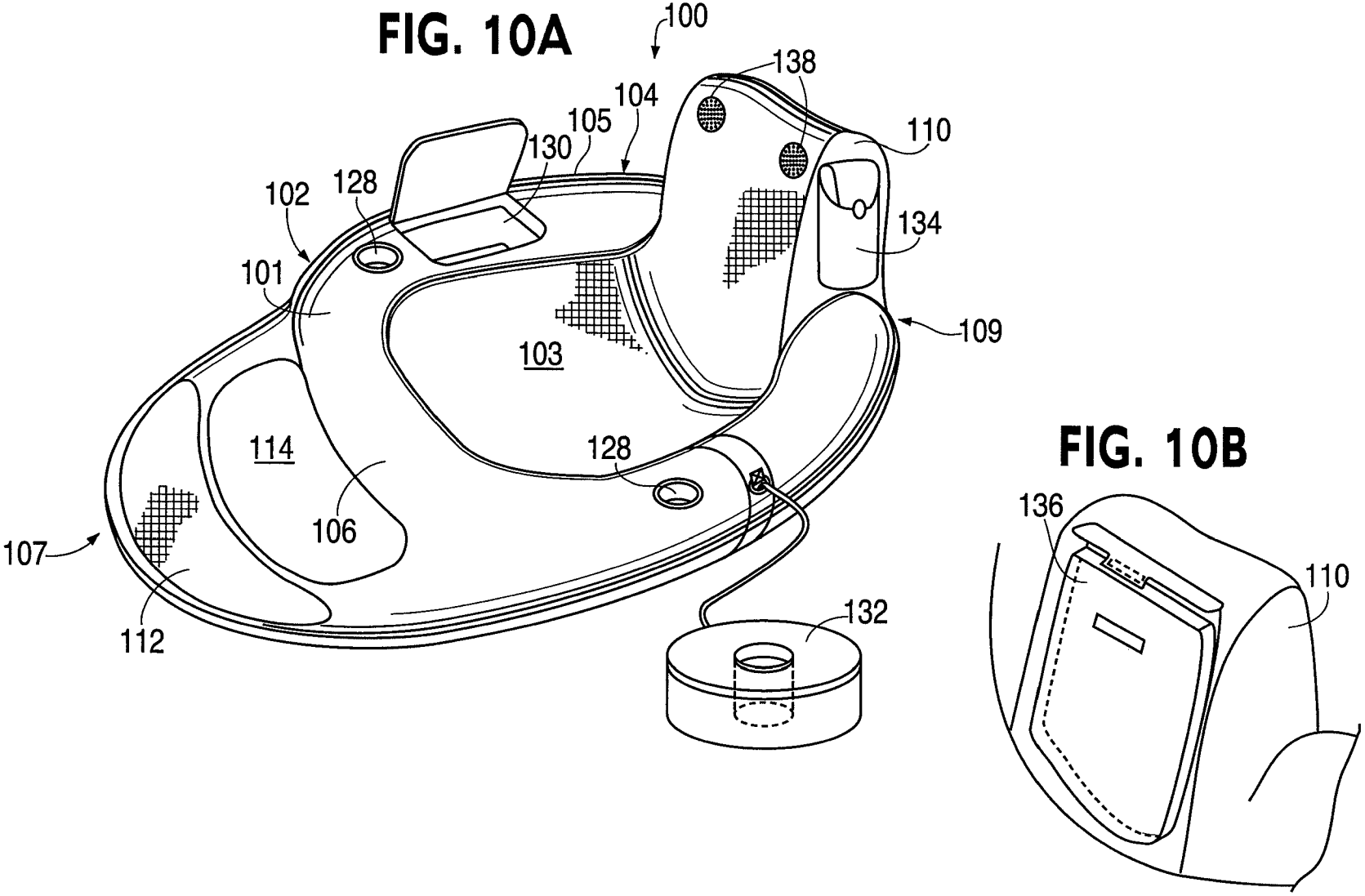
FIGS. 10A-B are perspective views of a collapsible flotation device having a variety of pockets, containers, and additional features, in accordance with embodiments of the invention.

In FIGS. 10A-B, various additional features associated with the collapsible flotation device 100 shown in FIGS. 1-4 are illustrated. These features, however, can be incorporated with all of embodiments of the invention. FIG. 10A is a perspective view of the collapsible flotation device 100 and FIG. 10B is a rear view of the back support member 110. The views shown in FIGS. 10A-B illustrate additional features of alternate embodiments of the invention. The flotation device 100 illustrated in FIG. 10A has pockets 128 positioned in the outer portion 101 of the panel 102, in which drinks, spray bottles, or other objects can be held. For example, an item that would provide added comfort to a user seated on the flotation device 100, which could be placed in a pocket 128, is a "mister" (e.g., a spray bottle having a fan attached thereto) to provide a cooling mist for a user seated on the device 100.

Additionally, a large container 130 is disposed within outer portion 101 of the panel 102, which could be used as a cooler, for example. A floating drink holder 132 is tethered to the flotation device 100, which can hold a variety of objects, such as a drink, or other desirable objects. Additional pockets 134, 136 are placed in different locations on the flotation device 100 for the convenience of the user in storing or carrying various items. In accordance with an embodiment of the invention, the various pockets 134, 136, and the container 130 may be sealable, so as to prevent water from entering therein and causing damage to the contents stored within these locations.

In addition to the features already described, the flotation device 100 shown in FIG. 10A also has speakers 138 to provide a user with music during use of the device 100. In accordance with an embodiment of the invention, an electronic music device, such as a radio receiver or recorded music player (not shown), along with its power source (not shown), could be carried in the pocket 134, and connected to the speakers 138 by way of a speaker jack contained within the pocket 134, or elsewhere. Additionally, other powered devices or power sources could be attached to the flotation device 100. For example, in accordance with an embodiment of the invention, solar panels could be attached to the device to provide power to any electrical devices on the flotation device.

Figure 11:
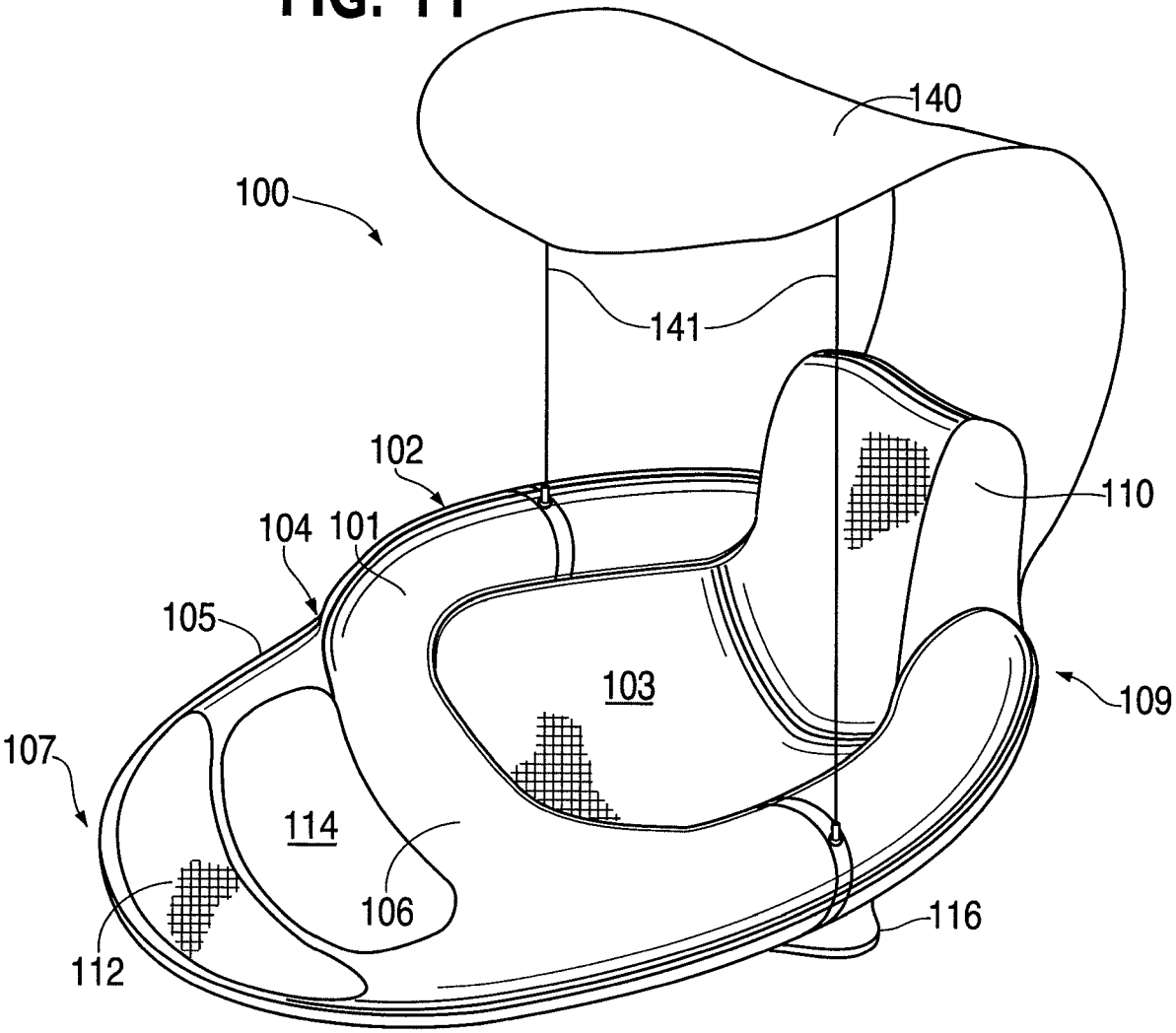
FIG. 11 is a perspective view of a collapsible flotation device having a covering, in accordance with an embodiment of the invention.

FIG. 11 is a perspective view of the flotation device 100 shown in FIGS. 1-4 outfitted with a cover 140. Although the cover is described in connection with the device 100 shown in FIGS. 1-4, it can be incorporated with any of the embodiments of the invention. The cover 140 can provide shade from the sun, block rain, or provide a location to attach mosquito netting to protect from mosquitoes or waterproof material to protect from rain. According to embodiments of the invention, the cover 140 may have a variety of shapes and forms. For example, the cover 140 may be formed using a coilable spring, an inflatable structure, or other support, allowing the cover 140 to maintain a stiff shape yet be collapsible. The cover 140 may be permanently or temporarily attached to the device, and may be temporarily secured to the panel 102 by way of tethers 141 or some other securing device. Examples of covers that can be used in connection with the flotation device of the invention are described in detail in several commonly owned, currently pending patent applications: U.S. patent application Ser. No. 09/797,948 filed on Mar. 5, 2001, now U.S. Pat. No. 6,698,827; PCT Application No. PCT/US02/06695 filed on Mar. 5, 2002, published as International Publication No. WO 02/069759 A2; and U.S. patent application Ser. No. 10/233,784 filed on Sep. 4, 2002, published as U.S. Publication No. US 2003/0080592; which are each incorporated by reference herein in their entireties.

Figure 12:
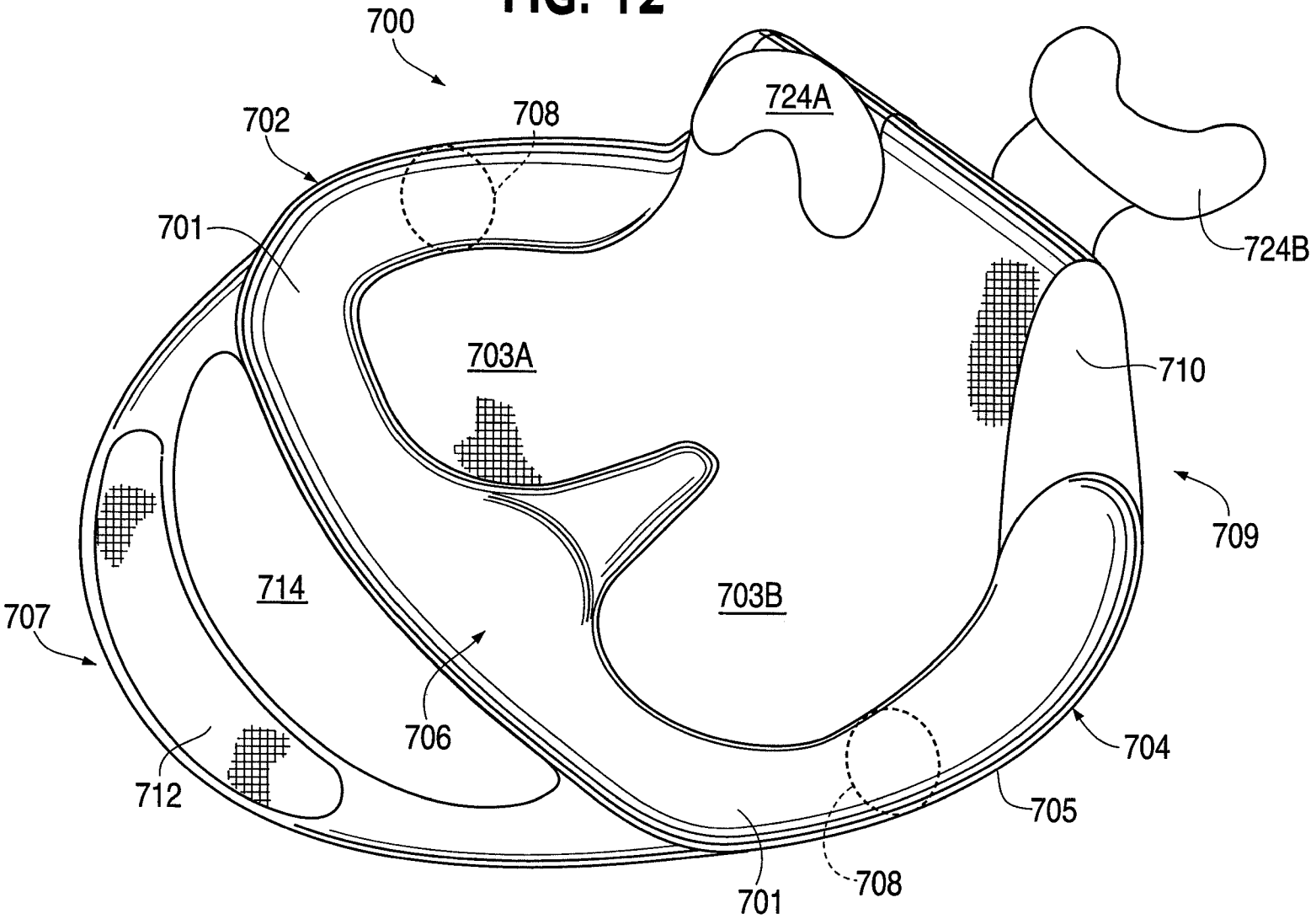
FIG. 12 is a perspective view of a multi-user collapsible flotation device configured to accommodate multiple users, in accordance with an embodiment of the invention.

FIG. 12 is a perspective view of a multi-user collapsible flotation device 700 according to an embodiment of the invention. The multi-user collapsible floatation device 700 shown is configured to be used by two users simultaneously. Thus, the panel 702 is divided into multiple inner portions 703A and 703B. Similarly, multiple headrests 724A, 724B are be provided for each user. The overall design of the dual collapsible flotation device is similar to the embodiments described above. Of course, basic modifications may be made to make such a device 700 usable by multiple users. For example, the inflatable bladder 708 will be required to provide a stronger buoyant force, to keep multiple users afloat on water, as opposed to just one.

It will be appreciated that many of the features of the various embodiments described above, which are provided for the convenience of a user, may be provided in connection with the multi-user collapsible flotation device 700 illustrated in FIG. 12, although many are not shown in that figure. Thus, pockets, containers, speakers, tethered containers, valves, carrying handles, and so forth, may be used in connection with the multi-user collapsible flotation device 700. The multi-user collapsible flotation device 700 may be formed from similar material to the collapsible flotation devices designed for use by a single user. Design considerations may, however, dictate that different materials be used, when such a device 700 is to configured to be used by multiple users. For example, the panel 702 may be required to be made from a stiffer material, which has less give. Additionally, other modifications that will be apparent to those skilled in the art may be required for such a multi-user collapsible flotation device 700.

An alternative embodiment designed to allow multiple users to float together involves linking multiple individual flotation devices. The flotation device 100 of FIGS. 1-4 is used as an example of the devices that can be connected in the manner shown in FIGS. 13A-B; however, devices according to any of the embodiments of the invention can be connected via the connecting portions 142 described in FIGS. 13A-B.

Figure 13A:
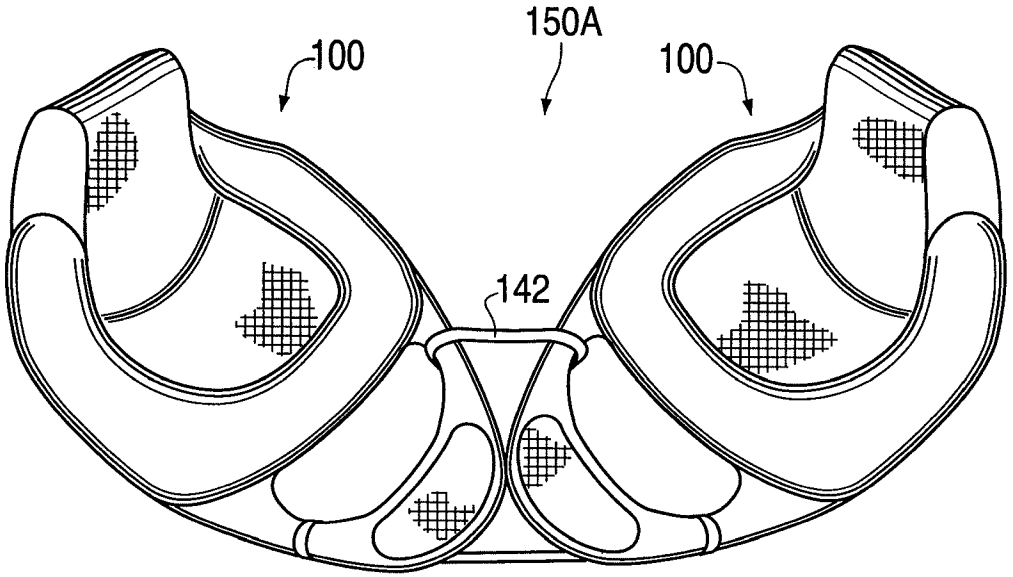
FIGS. 13A-B are perspective views of tandem collapsible flotation devices, in accordance with embodiments of the invention.

FIG. 13A shows a tandem flotation device configuration 150A according to an embodiment of the invention that links multiple flotation devices 100 using a connecting portion 142. This connecting portion 142 may be an elastic member, (e.g., bungee cord, a piece of rope, rubber), a non-elastic connecting material (e.g., a strap of material), or another material suitable for linking multiple collapsible flotation devices together. An additional advantage of the configuration shown in FIG. 13A is that users seated in the two flotation devices shown are essentially facing one another, and do not need to turn their heads to see each other, unlike the multi-user flotation device 700 shown in FIG. 12.

Figure 13B:
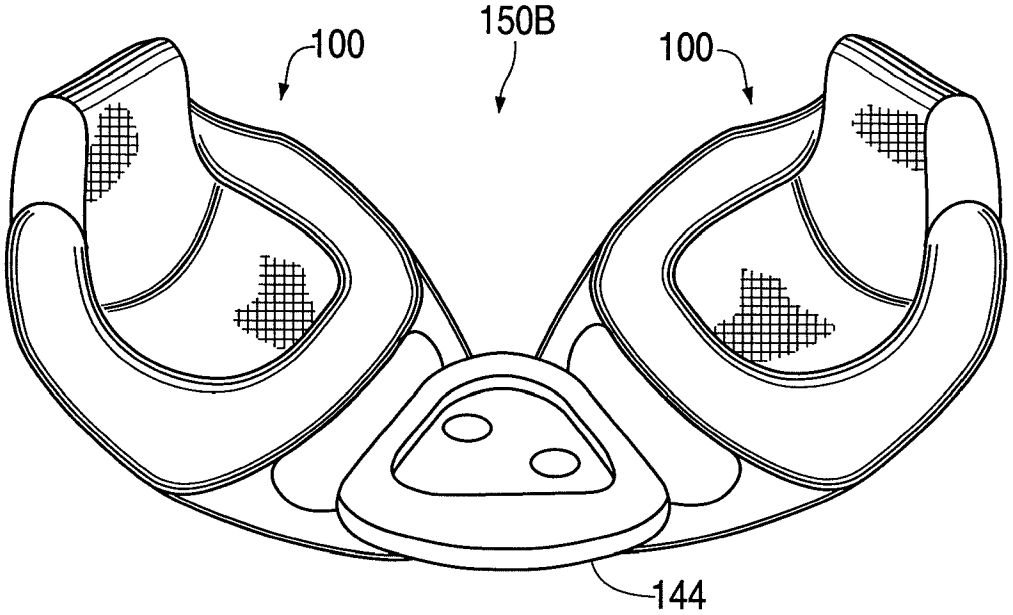

The tandem configuration 150B illustrated in FIG. 13B is similar to the one illustrated in FIG. 13A, in that multiple collapsible flotation devices 100 are connected together. In FIG. 13B, the devices are connected by way of a connecting portion 144, which may be permanently, or temporarily attached to the flotation devices. In the case shown in FIG. 13B, the connecting portion 144 is a table-like structure (i.e., a tray with drink holders). Additionally, in accordance with an embodiment of the invention, built in cooler (not shown), for example, may form at least part of the connecting portion 144, which would also provide a table-like structure. A variety of alternative connecting portions 144 could be used to connect multiple collapsible flotation devices 100 in the manner shown in FIG. 13B.

Figure 14:
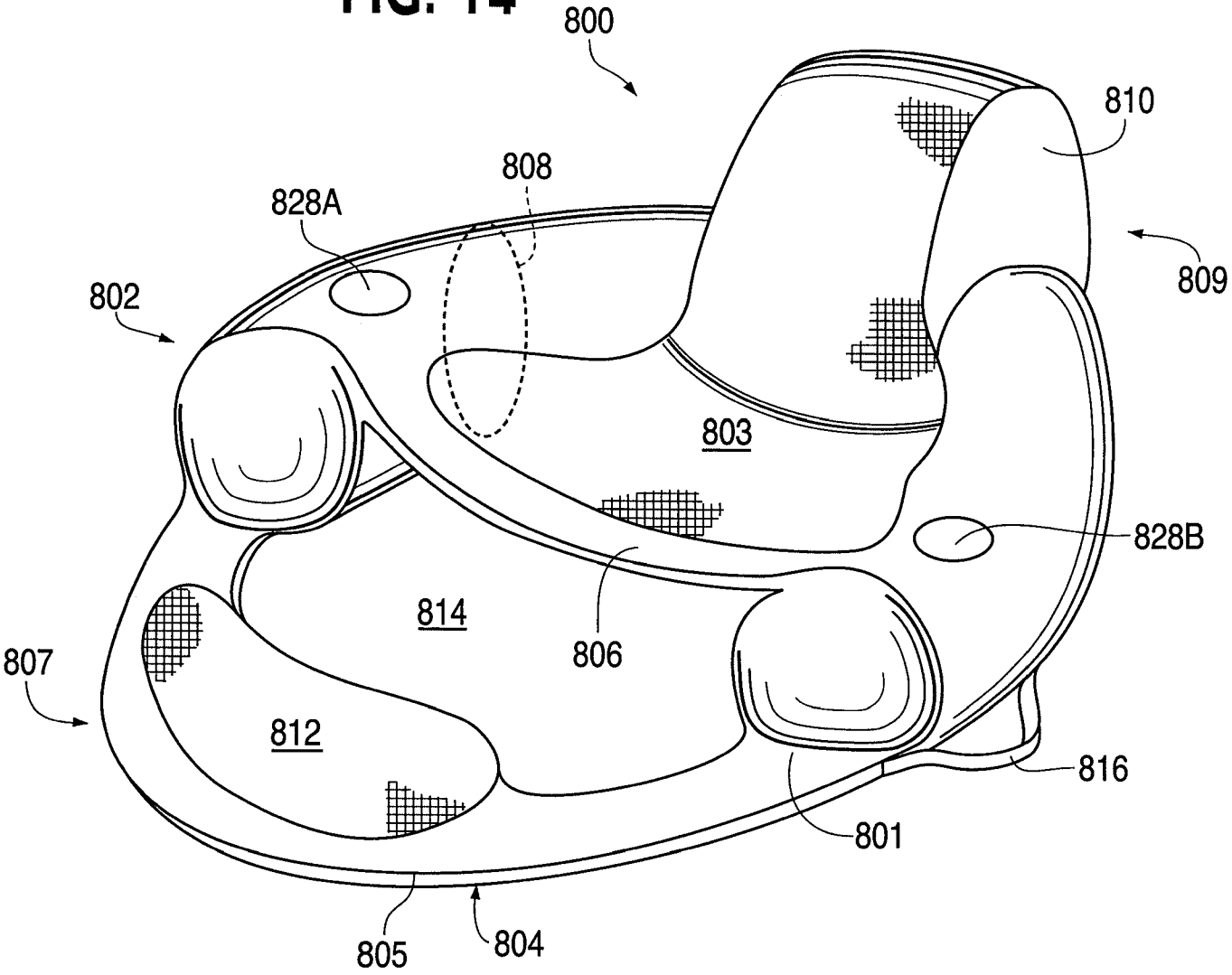
FIG. 14 is a perspective view of a collapsible flotation device, in accordance with an embodiment of the invention.

A collapsible flotation device 800 is shown in FIG. 14 in accordance with another embodiment of the invention. The flotation device 800 shown in FIG. 14 is similar to the flotation device 100 shown in FIGS. 1-4; however, the flotation device shown in FIG. 14 has a support member 806 that traverses the panel 802, which is not inflated. Although the support member 806 is not inflated, it is configured to provide support to a user seated on the panel 802 when used in combination with the panel 802, the inflatable bladder 808 (designated by way of a broken line), and/or the back support member 810. According to some embodiments of the invention, the inflatable bladder 808 may be enlarged to provide added buoyancy not provided by the support member 806. The flotation device 800 can have many of the other features described above in connection with various other embodiments of the invention, such one or more pockets 828A, 828B, one or more handles 816, one or more foot support members 812.

Figure 15:
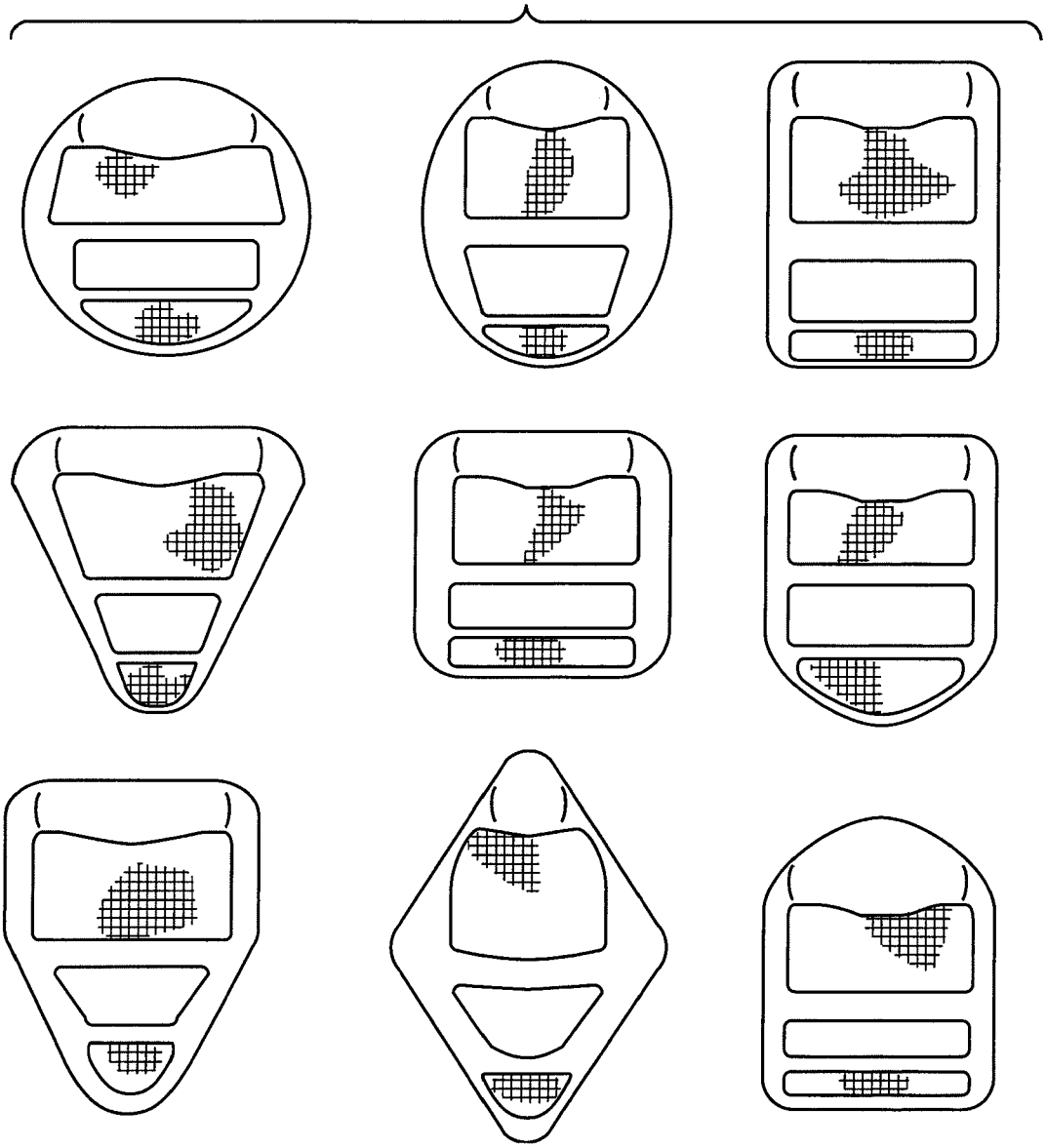
FIG. 15 illustrates a variety of shape configurations of collapsible flotation devices, in accordance with embodiments of the invention.

In FIG. 15, various shape configurations associated with various embodiments of the invention are illustrated. Each of the shape configurations illustrated in FIG. 15 make use of the same concepts discussed in connection with the embodiments described above. Each of the corners of the various shapes illustrated in FIG. 15 are somewhat rounded, which is generally the case for a coilable spring to function properly. FIG. 15 is not intended to be an all-inclusive showing of all of the shape configurations that could be used in connection with various embodiments of the present invention. Rather, these shapes are intended to be illustrative of a broad cross-section of shapes that could potentially be used. Other shapes can be used and are intended to be embraced within the scope of the present invention.

From the foregoing, it can be seen that the present invention provides a variety of collapsible flotation devices, which can be used to support a user in a seated position while floating on water. Additionally, according to various embodiments of the invention, the collapsible flotation devices may be provided with numerous convenient features, to provide additional functionality desired by users. Furthermore, various embodiments of the present invention provide for multi-user or multiple connected collapsible flotation devices, which may be used by multiple users.

The invention can be embodied in other specific forms without departing from the spirit or essential characteristics thereof. For example, while the invention has been described in the context of a device that makes use of an inflatable bladder, the floatation devices according to embodiments of the invention can make use of other buoyant members in the place of inflatable bladders that provide a buoyancy similar to the buoyancy provided by the inflatable bladder or bladders described above. One such buoyant member, for example, can be a foam insert that can be coupled to the device to provide adequate buoyant support to a user seated in the device.

Additionally, the embodiments of the collapsible flotation devices shown in the figures, multiple features could be added to these flotation devices according to a user's need, market demand, design specifications, or the like. Moreover, additional convenient features can be readily added to the flotation devices described above. For example, a fastening means could be provided to attach the flotation device of the present invention to a boat, or other vehicle. Likewise, an anchor could be added to maintain a position of the flotation device on a body of water. Other mechanical apparati could be added to the flotation devices of the present invention, such as holders for ores, holders for fishing poles, propellers, paddles, foot pedals to power the paddles, solar panels to power electronic devices, and the like.

Furthermore, it will be appreciated that the choice of materials and size and shape of the various elements of the invention could be varied according to particular design specifications or constraints requiring a flotation device according to the invention.

The presently disclosed embodiments are, therefore, considered in all respects to be illustrative and not restrictive. The scope of the invention is indicated by the appended claims, rather than the foregoing description, and all changes that come within the meaning and range of equivalents thereof are intended to be embraced therein.

What is claimed is:

1. A collapsible flotation device, comprising:

a flexible membrane including an inner portion and an outer portion, the outer portion including a perimeter of the flexible membrane, at least the inner portion of the flexible membrane being formed with a mesh; and an inflatable member forming a closed loop and defining at least in part a first opening within the closed loop, at least a portion of the flexible membrane disposed across the first opening of the inflatable member the inflatable member having a first portion configured to support a back of a user when the user is disposed on the collapsible flotation device and a second portion configured to be disposed beneath a leg of the user when the user is disposed on the collapsible flotation device, at least a portion of the flexible membrane being disposed between the first portion of the inflatable member and the second portion of the inflatable member, the first portion of the inflatable member having a height that is greater than a height of the second portion of the inflatable member when the inflatable member is inflated, wherein the flexible membrane is supported by the second portion of the inflatable member, the inflatable member defining at least in part a second opening of the collapsible flotation device, the second opening being at least partly free of the flexible membrane so as to be configured for the leg of the user to be placed therein and to provide access of a foot of the user to water below a bottom of the collapsible flotation device when the user is disposed on the collapsible flotation device and the collapsible flotation device is partially submerged in or is on water.

2. The collapsible flotation device of claim 1, wherein the at least the portion of the flexible membrane is disposed within the first opening of the inflatable member to entirely extend throughout the first opening.

3. The collapsible flotation device of claim 1, wherein:

the flexible membrane is disposed across the first opening of the inflatable member in a first direction and in a second direction perpendicular to the first direction.

4. The collapsible flotation device of claim 1, wherein:

the inflatable member has a third portion, at least a portion of the second opening being disposed between the second portion of the inflatable member and the third portion of the inflatable member, the first portion of the inflatable member has a height that is greater than a height of the third portion of the inflatable member when the inflatable member is inflated.

5. The collapsible flotation device of claim 1, wherein the first portion of the inflatable member and the second portion of the inflatable member are disposed at opposite sides of the flexible membrane.

6. The collapsible flotation device of claim 1, wherein:

the inflatable member has a third portion, at least a portion of the second opening being disposed between the second portion of the inflatable member and the third portion of the inflatable member, the first portion of the inflatable member has a height that is greater than a height of the third portion of the inflatable member when the inflatable member is inflated, the first portion of the inflatable member and the second portion of the inflatable member are disposed at opposite sides of the flexible membrane, the second portion of the inflatable member and the third portion of the inflatable member are disposed at opposite sides of the second opening.

7. The collapsible flotation device of claim 1, further comprising:

a shape-retaining member coupled to the inflatable member, the shape-retaining member being movable between a coiled configuration and an uncoiled configuration.

* * * * *